US009316071B2

(12) United States Patent
Feasey

(10) Patent No.: US 9,316,071 B2
(45) Date of Patent: Apr. 19, 2016

(54) CONTINGENT CONTINUOUS CIRCULATION DRILLING SYSTEM

(71) Applicant: Weatherford Technology Holdings, LLC, Houston, TX (US)

(72) Inventor: Guy F. Feasey, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 407 days.

(21) Appl. No.: 13/748,161

(22) Filed: Jan. 23, 2013

(65) Prior Publication Data

US 2014/0202767 A1 Jul. 24, 2014

(51) Int. Cl.

| | |
|---|---|
| ***E21B 19/00*** | (2006.01) |
| ***E21B 21/08*** | (2006.01) |
| ***E21B 33/064*** | (2006.01) |
| ***E21B 19/16*** | (2006.01) |

(52) U.S. Cl.

CPC ..... *E21B 21/08* (2013.01); *E21B 19/006* (2013.01); *E21B 19/16* (2013.01); *E21B 33/064* (2013.01)

(58) Field of Classification Search

USPC ..... 166/85.1, 85.4, 320, 324, 379, 380, 166/381; 175/57, 218

See application file for complete search history.

(56) References Cited

U.S. PATENT DOCUMENTS

| | | | | |
|---|---|---|---|---|
| 4,531,591 | A * | 7/1985 | Johnston | 175/57 |
| 5,388,651 | A | 2/1995 | Berry | |
| 7,007,753 | B2 | 3/2006 | Robichaux et al. | |
| 7,270,189 | B2 | 9/2007 | Brown et al. | |
| 7,665,530 | B2 | 2/2010 | Wells et al. | |
| 7,757,759 | B2 | 7/2010 | Jahn et al. | |
| 2005/0061546 | A1 | 3/2005 | Hannegan | |
| 2006/0060385 | A1 | 3/2006 | Amaudric Du Chaffaut et al. | |
| 2009/0025930 | A1 | 1/2009 | Iblings et al. | |
| 2009/0151934 | A1 | 6/2009 | Heidecke et al. | |
| 2009/0166034 | A1* | 7/2009 | Mundell | 166/250.15 |
| 2009/0205827 | A1* | 8/2009 | Swietlik et al. | 166/285 |
| 2011/0083904 | A1 | 4/2011 | Reddoch, Sr. | |
| 2011/0114387 | A1 | 5/2011 | Belcher et al. | |
| 2011/0155379 | A1 | 6/2011 | Bailey et al. | |
| 2011/0203848 | A1* | 8/2011 | Krueger | E21B 21/08 175/57 |
| 2012/0175117 | A1* | 7/2012 | Mosing et al. | 166/285 |

(Continued)

FOREIGN PATENT DOCUMENTS

WO 2012100259 A2 7/2012

OTHER PUBLICATIONS

PCT International Search Report and Written Opinion dated Nov. 17, 2014, International Application No. PCT/US2014/012584.

*Primary Examiner* — Sean Andrish
(74) *Attorney, Agent, or Firm* — Patterson & Sheridan LLP

(57) ABSTRACT

A method for deploying a tubular string into a wellbore includes: injecting fluid through a top drive and flow sub into a top of the tubular string and lowering the tubular string into the wellbore. The flow sub: connects the tubular string top to a quill of the top drive, is in a top injection mode, and has a closed port and an open bore. The method further includes halting injection of the fluid through the top drive and lowering of the tubular string. The method further includes, while injection and lowering are halted: disconnecting the flow sub from the tubular string top; adding one or more tubular joints to the tubular string and connecting the flow sub to a top of the added joints. The method further includes resuming injection of the fluid through the top drive and lowering of the tubular string.

15 Claims, 16 Drawing Sheets

(56) References Cited

U.S. PATENT DOCUMENTS

2012/0211244 A1* 8/2012 Heidecke et al. ..... 166/380
2012/0261138 A1 10/2012 Zhou
2013/0068532 A1 3/2013 Bansal et al.
2014/0202768 A1* 7/2014 Noske ..... 175/57

* cited by examiner

CONTINGENT CONTINUOUS CIRCULATION DRILLING SYSTEM

BACKGROUND OF THE INVENTION

1. Field of the Invention

The present invention generally relates to a contingent continuous circulation drilling system.

2. Description of the Related Art

In many drilling operations to recover hydrocarbons, a drill string made by assembling joints of drill pipe with threaded connections and having a drill bit at the bottom is rotated to move the drill bit. Typically drilling fluid, such as oil or water based mud, is circulated to and through the drill bit to lubricate and cool the bit and to facilitate the removal of cuttings from the wellbore that is being formed. The drilling fluid and cuttings returns to the surface via an annulus formed between the drill string and the wellbore. At the surface, the cuttings are removed from the drilling fluid and the drilling fluid is recycled.

As the drill bit penetrates into the earth and the wellbore is lengthened, more joints of drill pipe are added to the drill string. This involves stopping the drilling while the joints are added. The process is reversed when the drill string is removed or tripped, e.g., to replace the drill bit or to perform other wellbore operations. Interruption of drilling may mean that the circulation of the mud stops and has to be re-started when drilling resumes. This stoppage can cause deleterious effects on the walls of the wellbore being drilled and can lead to formation damage and problems in maintaining an open wellbore. Further, restarting fluid circulation following a cessation of circulation may result in the overpressuring of a formation in which the wellbore is being formed.

SUMMARY OF THE INVENTION

The present invention generally relates to a contingent continuous circulation drilling system. In one embodiment, a method for deploying a tubular string into a wellbore includes: injecting fluid through a top drive and flow sub into a top of the tubular string and lowering the tubular string into the wellbore. The flow sub connects the tubular string top to a quill of the top drive. The flow sub is in a top injection mode. The flow sub has a closed port formed through a wall thereof and an open bore conducting the fluid from the quill into the tubular string top. The method further includes halting injection of the fluid through the top drive and lowering of the tubular string. The method further includes, while injection and lowering are halted: disconnecting the flow sub from the tubular string top; adding one or more tubular joints to the tubular string and connecting the flow sub to a top of the added joints. The method further includes resuming injection of the fluid through the top drive and lowering of the tubular string.

In another embodiment, a top drive system includes a flow sub and a top drive. The flow sub includes a tubular housing having: a longitudinal bore formed therethrough, a flow port formed through a wall thereof, an upper coupling, and a lower coupling for connection to a tubular; a bore valve operable between an open position and a closed position, wherein the bore valve allows free passage through the bore in the open position and isolates an upper portion of the bore from a lower portion of the bore in the closed position; and a valve member for selectively opening and closing the flow port. The top drive includes: a motor operable to rotate a quill; a swivel having an inlet for receiving a Kelly hose and an outlet in fluid communication with the quill; and a backup wrench movable between an upper position and a lower position. The upper coupling is connected to the quill. The backup wrench is engagable with an upper portion of the housing in the upper position. The backup wrench is engageable with a threaded coupling of the tubular in the lower position.

In another embodiment, a method for deploying a tubular string into a wellbore includes injecting fluid through a top drive and flow sub into a top of the tubular string and lowering the tubular string into the wellbore. The flow sub connects the tubular string top to a quill of the top drive. The flow sub is in a top injection mode. The flow sub has a closed port formed through a wall thereof and an open bore conducting the fluid from the quill into the tubular string top. The method further includes halting lowering of the tubular string due to failure of the top drive. The method further includes, while lowering is halted, shifting the flow sub to a side injection mode and injecting the fluid into the port. The method further includes, while injecting the fluid into the port: disconnecting the quill from the flow sub; and servicing or replacing the top drive.

In another embodiment, a method for deploying a tubular string into a wellbore includes injecting fluid through a top drive and flow sub into a top of the tubular string and lowering the tubular string into the wellbore. The flow sub connects the tubular string top to a quill of the top drive. The flow sub is in a top injection mode. The flow sub has a closed port formed through a wall thereof and an open bore conducting the fluid from the quill into the tubular string top. The method further includes halting lowering of the tubular string. The method further includes while lowering is halted, shifting the flow sub to a side injection mode and injecting the fluid into an annulus of the wellbore, thereby circulating from the annulus, up a bore of the tubular string, and to the open port.

In another embodiment, a method for deploying a tubular string into a wellbore includes injecting fluid into an annulus of the wellbore, thereby circulating from the annulus, up a bore of the tubular string, and to an open port of a flow sub connected to a top of the tubular string and lowering the tubular string into the wellbore. The method further includes halting lowering of the tubular string. The method further includes, while lowering is halted: disconnecting the flow sub from the tubular string top; adding one or more tubular joints to the tubular string and connecting the flow sub to a top of the added joints. The method further includes resuming lowering of the tubular string.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
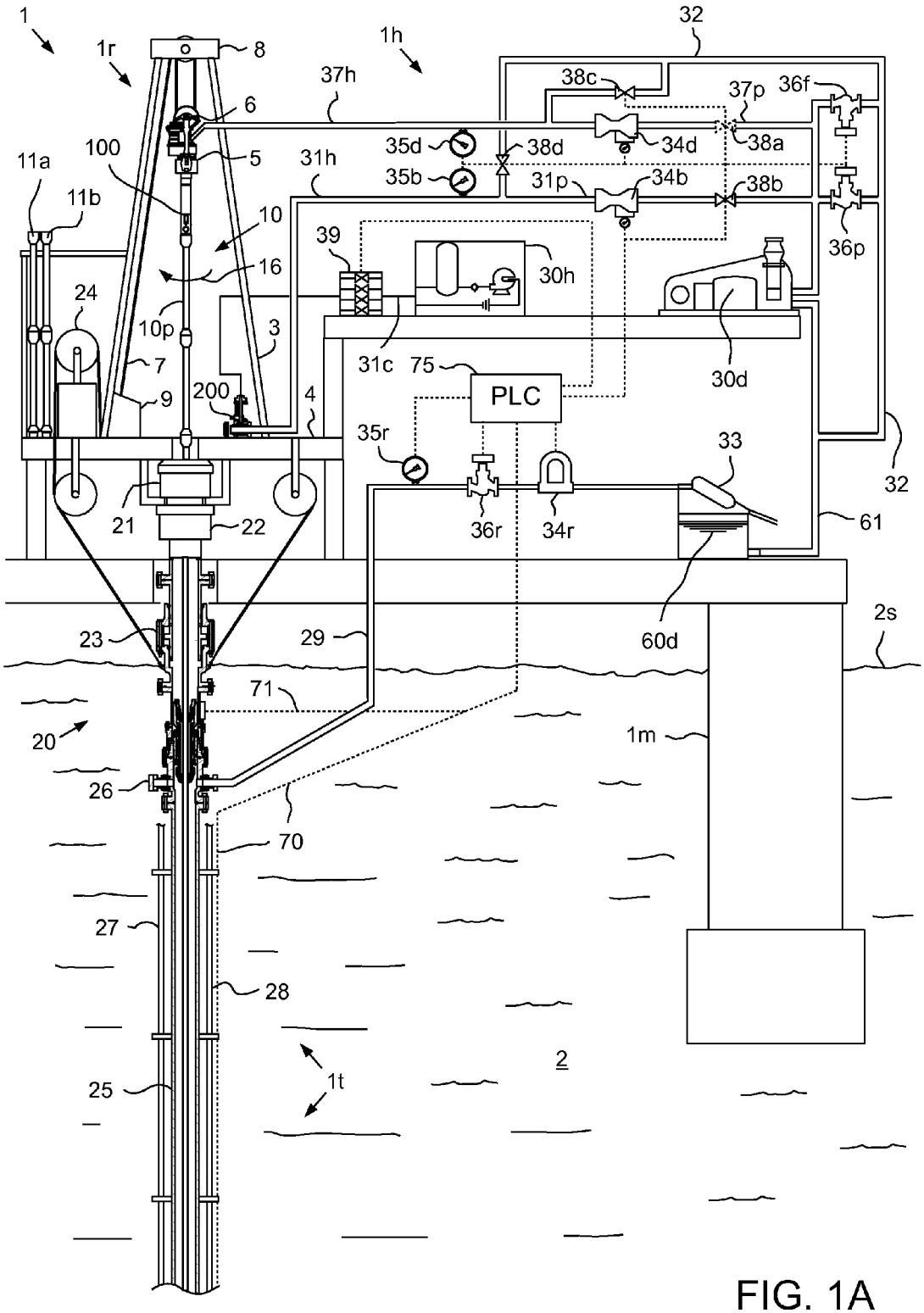
FIGS. 1A-1C illustrate a drilling system in a drilling mode, according to one embodiment of the present invention.
Figure 1B:
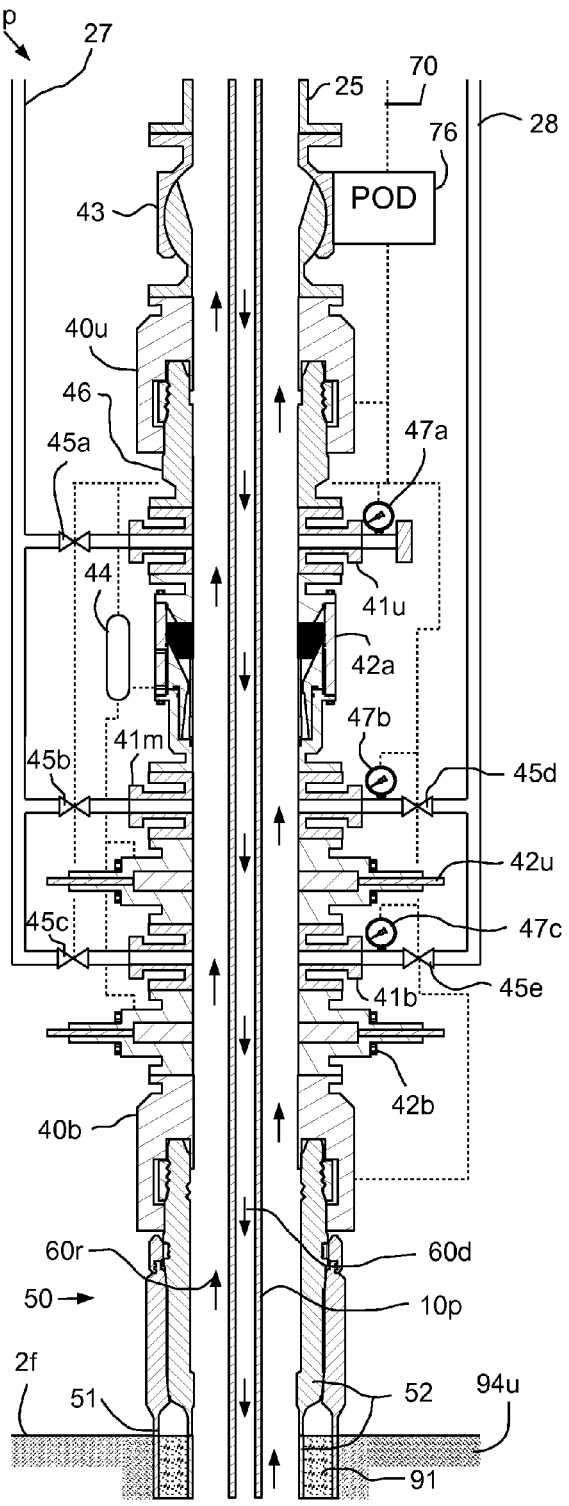
Figure 1C:
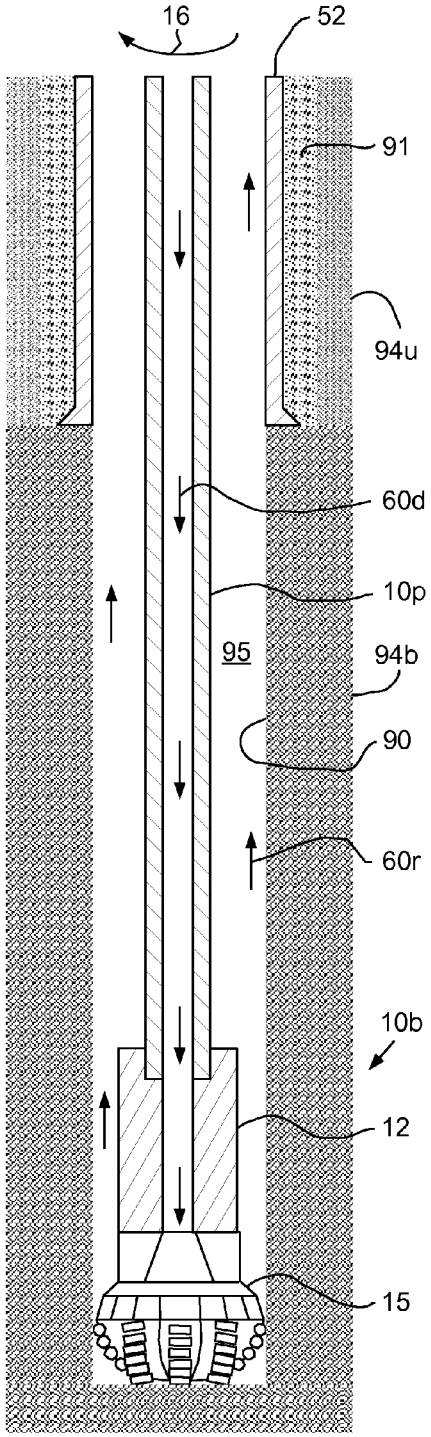

FIGS. 1A-1C illustrate a drilling system 1 in a drilling mode, according to one embodiment of the present invention. The drilling system 1 may include a mobile offshore drilling unit (MODU) 1*m*, such as a semi-submersible, a drilling rig 1*r*, a fluid handling system 1*h*, a fluid transport system 1*t*, and a pressure control assembly (PCA) 1*p*. The MODU 1*m* may carry the drilling rig 1*r* and the fluid handling system 1*h* aboard and may include a moon pool, through which drilling operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 50.

Alternatively, the MODU 1*m* may be a drill ship. Alternatively, a fixed offshore drilling unit or a non-mobile floating offshore drilling unit may be used instead of the MODU 1*m*. Alternatively, the wellbore may be subsea having a wellhead located adjacent to the waterline and the drilling rig may be a located on a platform adjacent the wellhead. Alternatively, the drilling system may be used for drilling a subterranean (aka land based) wellbore and the MODU 1*m* may be omitted.

Figure 4A:
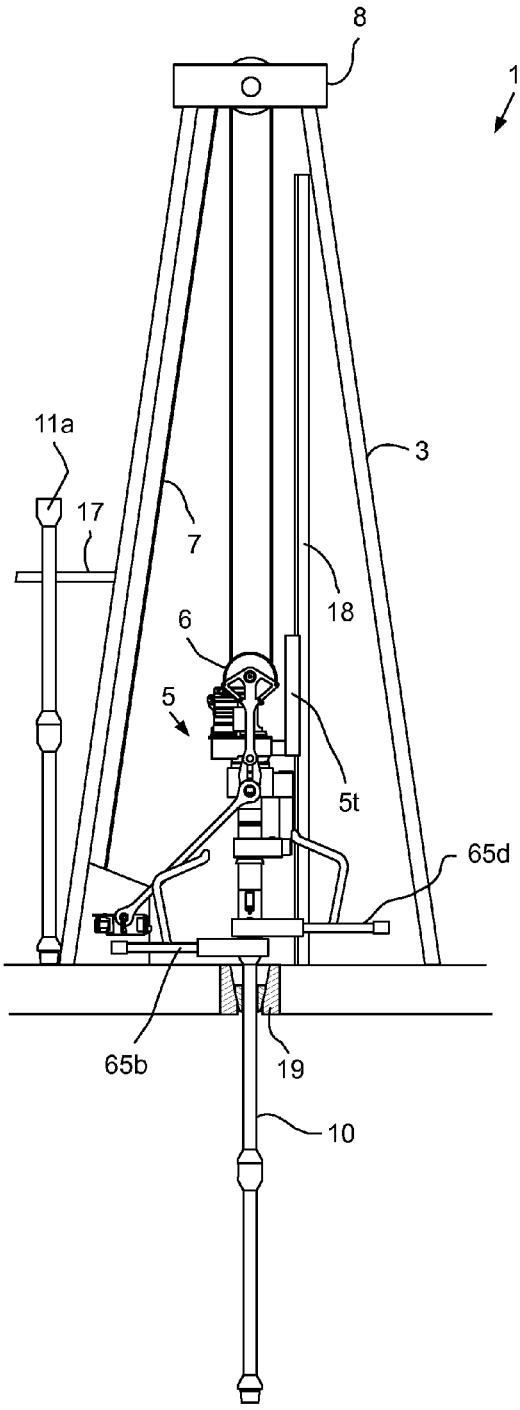
FIGS. 4A-4H illustrate extending the drill string in drilling mode.
Figure 4B:
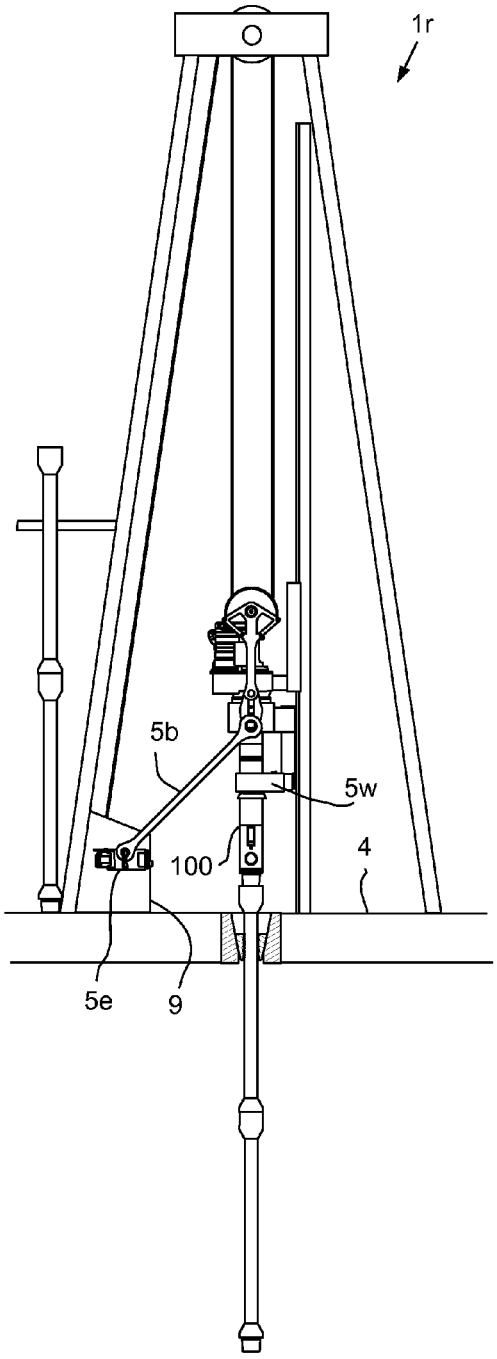
Figure 4C:
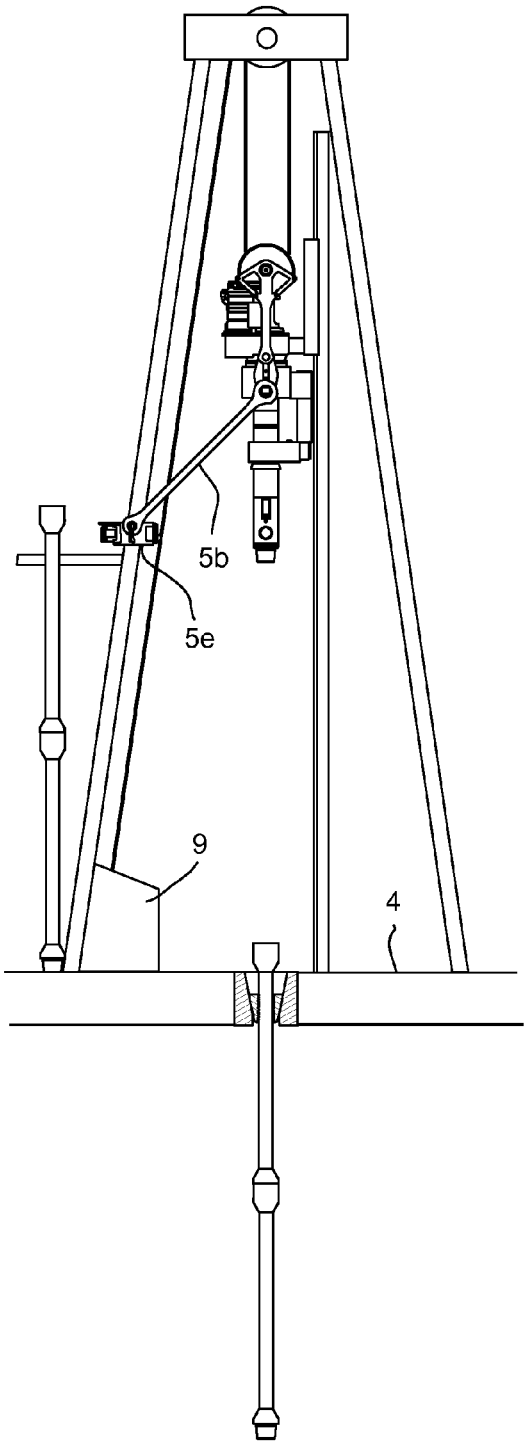
Figure 4D:
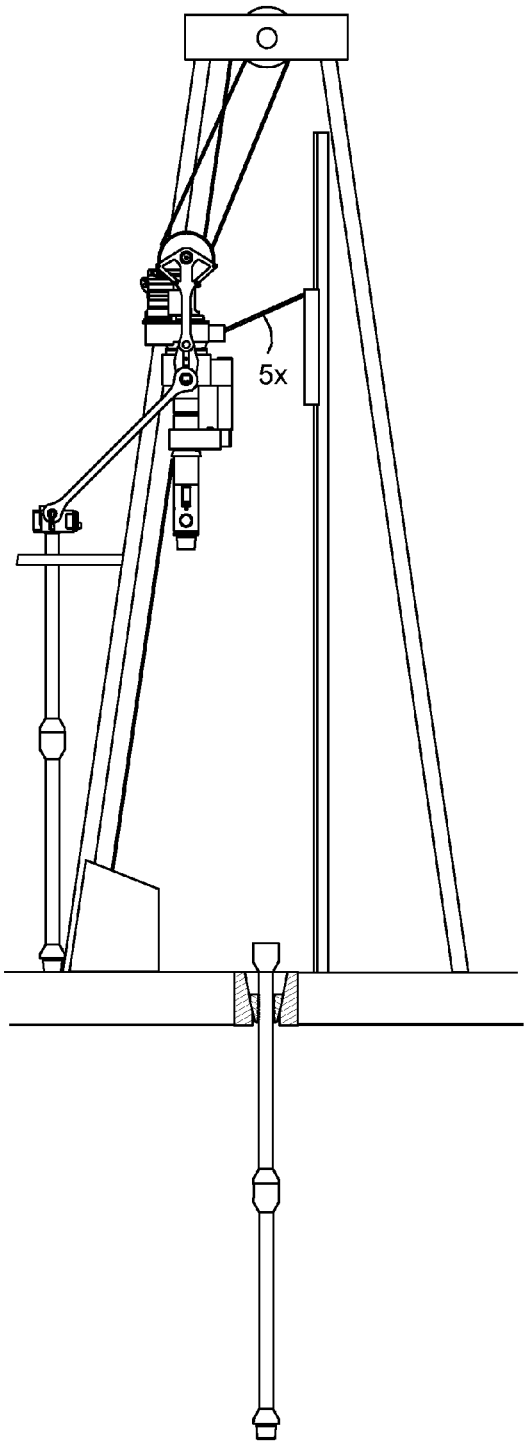
Figure 4E:
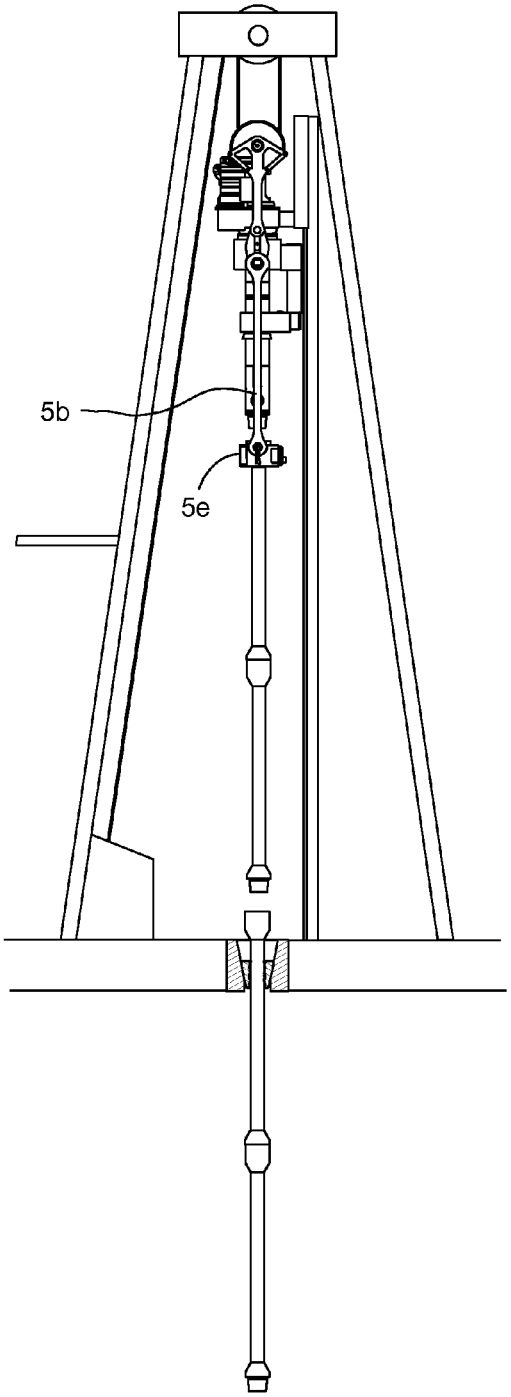
Figure 4F:
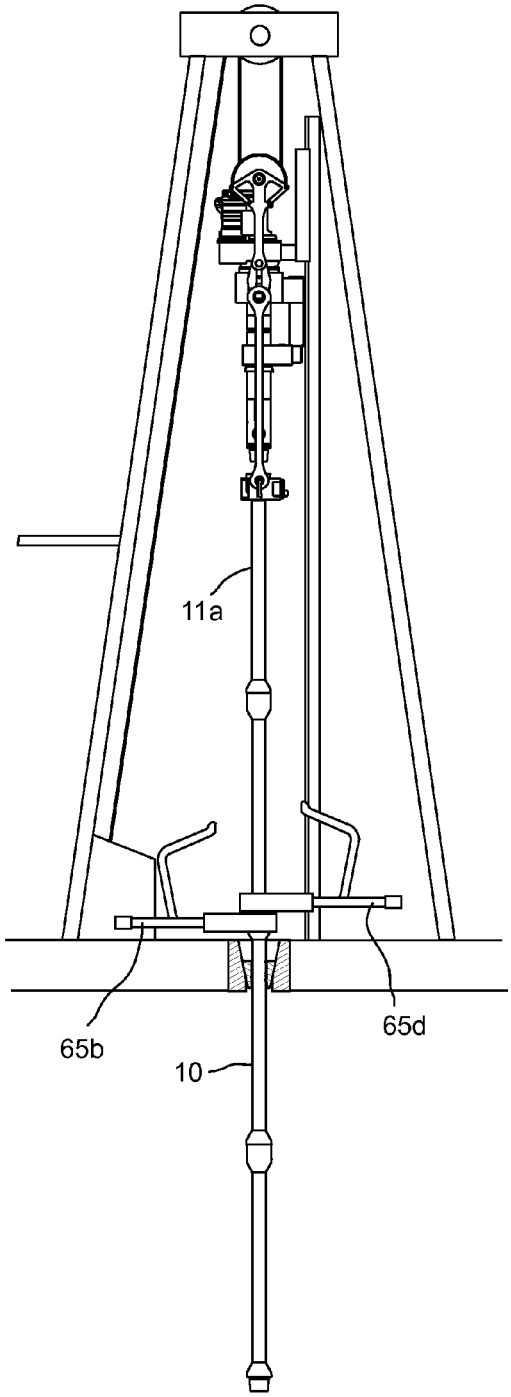
Figure 4G:
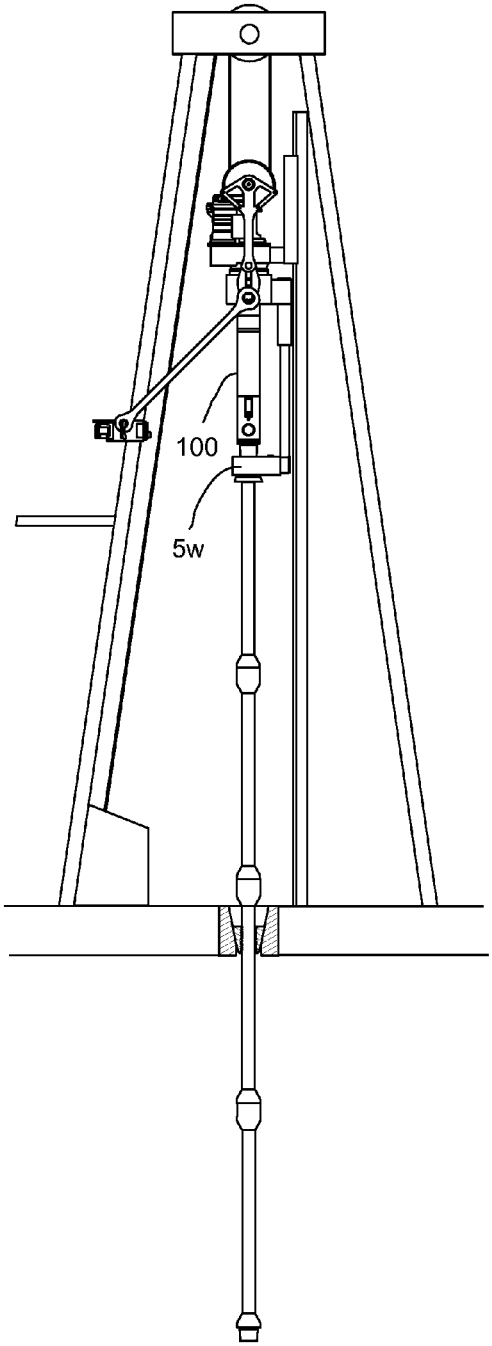
Figure 4H:
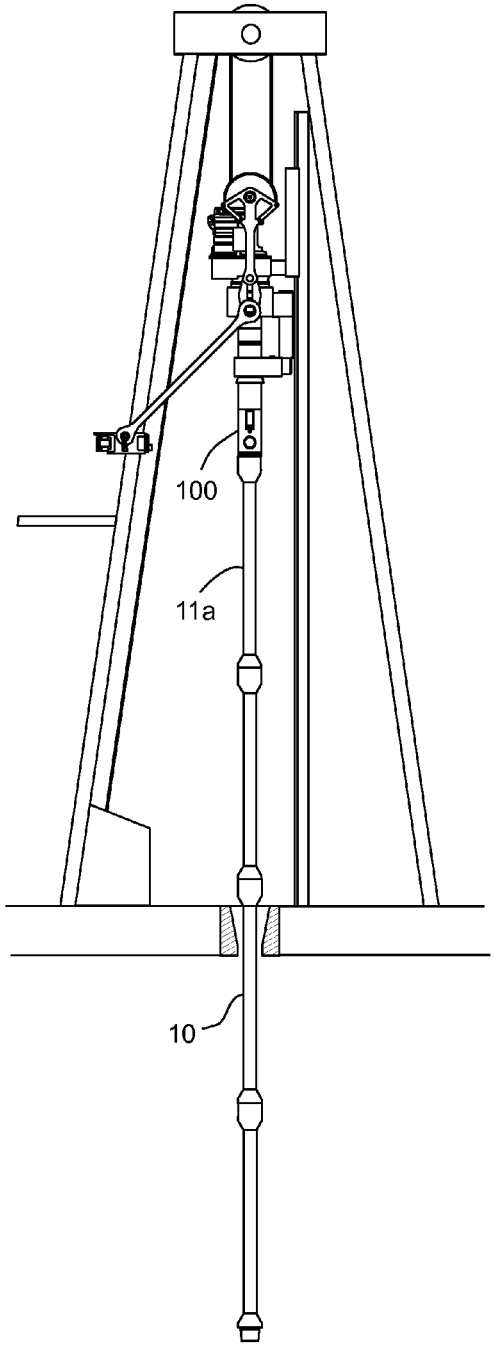

The drilling rig 1*r* may include a derrick 3 having a rig floor 4 at its lower end having an opening corresponding to the moonpool. The drilling rig 1*r* may further include a rail 18 (FIG. 4A) extending from the rig floor 4 toward the crown block 8. The drilling rig 1*r* may further include a top drive 5. The top drive 5 may include an extender 5*x* (FIG. 4D), motor 5*m* (FIG. 5B), an inlet 5*i*, a gear box 5*g*, a swivel 5*r*, a quill 5*q*, a trolley 5*t* (FIG. 4A), a pipe hoist, and a backup wrench 5*w*. The top drive motor 5*m* may be electric or hydraulic and have a rotor and stator. The motor 5*m* may be operable to rotate the rotor relative to the stator which may also torsionally drive 16 the quill 5*q* via one or more gears (not shown) of the gear box 5*g*. The quill 5*q* may have a coupling (not shown), such as splines, formed at an upper end thereof and torsionally connecting the quill to a mating coupling of one of the gears. Housings of the motor 5*m*, swivel 5*r*, gear box 5*g*, and backup wrench 5*w* may be connected to one another, such as by fastening, so as to form a non-rotating frame 5*f*. The top drive 5 may further include an interface (not shown) for receiving power and/or control lines.

The extender 5*x* may torsionally connect the frame 5*f* to the trolley 5*t* and include one or more arms and an actuator, such as a piston and cylinder assembly. The extender arms may pivotally connect to the frame 5*f* and trolley 5*t* such that operation of the extender actuator may horizontally extend or retract the frame (and rotating components) relative to the trolley and rail 18. The trolley 5*t* may ride along the rail 18, thereby torsionally restraining the frame 5*f* while allowing vertical movement of the top drive 5 with a travelling block 6. The traveling block 6 may be connected to the frame 5*f*, such as by fastening to suspend the top drive from the derrick 3. Alternatively, the top drive 5 may include a becket for receiving a hook of the traveling block 6.

The swivel 5*r* may include one or more bearings for longitudinally and rotationally supporting rotation of the quill 5*q* relative to the frame 5*f*. The inlet 5*i* may have a coupling for connection to a Kelly hose 37*h* and provide fluid communication between the Kelly hose and a bore of the quill 5*q*. The quill 5*q* may have a coupling, such as a threaded pin, formed at a lower end thereof for connection to a mating coupling of a flow sub 100. The pipe hoist may include an elevator 5*e*, one or more links 5*b* pivotally connecting the elevator to the top drive frame 5*f*, and a link tilt (not shown), such as a piston and cylinder assembly, for horizontally extending or retracting the elevator relative to the frame. The elevator 5*e* may be manually opened and closed or the pipe hoist may include an actuator (not shown) for opening and closing the elevator. Additionally, the top drive 5 may further include a (first) thread compensator (not shown).

The backup wrench 5*w* may include a tong, a telescoping arm, an arm actuator (not shown), and a tong actuator (not shown). The telescoping arm may torsionally connect the tong to the frame 5*f* while allowing the arm actuator to longitudinally move the tong relative to the frame. The tong may include a pair of jaws and the tong actuator may radially move one of the jaws radially toward or away from the other jaw. The arm actuator may also operate as a second thread compensator while making up a threaded connection between the flow sub 100 and one or more of the stands 11*a,b*.

The traveling block 6 may be supported by wire rope 7 connected at its upper end to a crown block 8. The wire rope 7 may be woven through sheaves of the blocks 6, 8 and extend to drawworks 9 for reeling thereof, thereby raising or lowering the traveling block 6 relative to the derrick 3. A top of the drill string 10 may be connected to the flow sub 100, such as by a threaded connection, or by a gripper (not shown), such as a torque head or spear. The drilling rig 1*r* may further include a drill string compensator (not shown) to account for heave of the MODU 1*m*. The drill string compensator may be disposed between the traveling block 6 and the top drive 5 (aka hook mounted) or between the crown block 8 and the derrick 3 (aka top mounted).

The fluid transport system it may include the drill string 10, an upper marine riser package (UMRP) 20, a marine riser 25, a booster line 27, and a choke line 28. The drill string 10 may include a bottomhole assembly (BHA) 10*b* and joints of drill pipe 10*p* connected together, such as by threaded couplings. The BHA 10*b* may be connected to the drill pipe 10*p*, such as by a threaded connection, and include a drill bit 15 and one or more drill collars 12 connected thereto, such as by a threaded connection. The drill bit 15 may be rotated 16 by the top drive 5 via the drill pipe 10*p* and/or the BHA 10*b* may further include a drilling motor (not shown, see 612) for rotating the drill bit. The BHA 10*b* may further include an instrumentation sub (not shown), such as a measurement while drilling (MWD) and/or a logging while drilling (LWD) sub.

The PCA 1*p* may be connected to a wellhead 50 located adjacent to a floor 2*f* of the sea 2. A conductor string 51 may be driven into the seafloor 2*f*. The conductor string 51 may include a housing and joints of conductor pipe connected together, such as by threaded connections. Once the conductor string 51 has been set, a subsea wellbore 90 may be drilled into the seafloor 2*f* and a casing string 52 may be deployed into the wellbore. The casing string 52 may include a wellhead housing and joints of casing connected together, such as by threaded connections. The wellhead housing may land in the conductor housing during deployment of the casing string 52. The casing string 52 may be cemented 91 into the wellbore 90. The casing string 52 may extend to a depth adjacent a bottom of an upper formation 94*u*. The upper formation 94*u* may be non-productive and a lower formation 94*b* may be a hydrocarbon-bearing reservoir. Alternatively, the lower formation 94*b* may be environmentally sensitive, such as an aquifer, or unstable. Although shown as vertical, the wellbore 90 may include a vertical portion and a deviated, such as horizontal, portion.

The PCA 1*p* may include a wellhead adapter 40*b*, one or more flow crosses 41*u,m,b*, one or more blow out preventers (BOPs), a lower marine riser package (LMRP), one or more accumulators 44, and a receiver 46. The LMRP may include a control pod 76, a flex joint 43, and a connector 40*u*. The wellhead adapter 40*b*, flow crosses 41*u,m,b*, BOPs, receiver 46, connector 40*u*, and flex joint 43, may each include a housing having a longitudinal bore therethrough and may each be connected, such as by flanges, such that a continuous bore is maintained therethrough. The bore may have drift diameter, corresponding to a drift diameter of the wellhead 50.

Each of the connector 40*u* and wellhead adapter 40*b* may include one or more fasteners, such as dogs, for fastening the LMRP to the BOPs and the PCA 1*p* to an external profile of the wellhead housing, respectively. Each of the connector 40*u* and wellhead adapter 40*b* may further include a seal sleeve for engaging an internal profile of the respective receiver 46 and wellhead housing. Each of the connector 40*u* and wellhead adapter 40*b* may be in electric or hydraulic communication with the control pod 76 and/or further include an electric or hydraulic actuator and an interface, such as a hot stab, so that a remotely operated subsea vehicle (ROV) (not shown) may operate the actuator for engaging the dogs with the external profile.

The LMRP may receive a lower end of the riser 25 and connect the riser to the PCA 1*p*. The control pod 76 may be in electric, hydraulic, and/or optical communication with a programmable logic controller (PLC) 75 onboard the MODU 1*m* via an umbilical 70. The control pod 76 may include one or more control valves (not shown) in communication with the BOPs for operation thereof. Each control valve may include an electric or hydraulic actuator in communication with the umbilical 70. The umbilical 70 may include one or more hydraulic or electric control conduit/cables for the actuators. The accumulators 44 may store pressurized hydraulic fluid for operating the BOPs. Additionally, the accumulators 44 may be used for operating one or more of the other components of the PCA 1*p*. The umbilical 70 may further include hydraulic, electric, and/or optic control conduit/cables for operating various functions of the PCA 1*p*. The PLC 75 may operate the PCA 1*p* via the umbilical 70 and the control pod 76.

A lower end of the booster line 27 may be connected to a branch of the flow cross 41*u* by a shutoff valve 45*a*. A booster manifold may also connect to the booster line lower end and have a prong connected to a respective branch of each flow cross 41*m,b*. Shutoff valves 45*b,c* may be disposed in respective prongs of the booster manifold. Alternatively, a separate kill line (not shown) may be connected to the branches of the flow crosses 41*m,b* instead of the booster manifold. An upper end of the booster line 27 may be connected to an outlet of a booster pump (not shown). A lower end of the choke line 28 may have prongs connected to respective second branches of the flow crosses 41*m,b*. Shutoff valves 45*d,e* may be disposed in respective prongs of the choke line lower end.

A pressure sensor 47*a* may be connected to a second branch of the upper flow cross 41*u*. Pressure sensors 47*b,c* may be connected to the choke line prongs between respective shutoff valves 45*d,e* and respective flow cross second branches. Each pressure sensor 47*a-c* may be in data communication with the control pod 76. The lines 27, 28 and umbilical 70 may extend between the MODU 1*m* and the PCA 1*p* by being fastened to brackets disposed along the riser 25. Each line 27, 28 may be a flow conduit, such as coiled tubing. Each shutoff valve 45*a-e* may be automated and have a hydraulic actuator (not shown) operable by the control pod 76 via fluid communication with a respective umbilical conduit or the LMRP accumulators 44. Alternatively, the valve actuators may be electrical or pneumatic.

The riser 25 may extend from the PCA 1*p* to the MODU 1*m* and may connect to the MODU via the UMRP 20. The UMRP 20 may include a diverter 21, a flex joint 22, a slip (aka telescopic) joint 23, a tensioner 24, and a rotating control device (RCD) 26. A lower end of the RCD 26 may be connected to an upper end of the riser 25, such as by a flanged connection. The slip joint 23 may include an outer barrel connected to an upper end of the RCD 26, such as by a flanged connection, and an inner barrel connected to the flex joint 22, such as by a flanged connection. The outer barrel may also be connected to the tensioner 24, such as by a tensioner ring (not shown).

The flex joint 22 may also connect to the diverter 21, such as by a flanged connection. The diverter 21 may also be connected to the rig floor 4, such as by a bracket. The slip joint 23 may be operable to extend and retract in response to heave of the MODU 1*m* relative to the riser 25 while the tensioner 24 may reel wire rope in response to the heave, thereby supporting the riser 25 from the MODU 1*m* while accommodating the heave. The flex joints 23, 43 may accommodate respective horizontal and/or rotational (aka pitch and roll) movement of the MODU 1*m* relative to the riser 25 and the riser relative to the PCA 1*p*. The riser 25 may have one or more buoyancy modules (not shown) disposed therealong to reduce load on the tensioner 24.

The RCD 26 may include a housing, a piston, a latch, and a rider. The housing may be tubular and have one or more sections connected together, such as by flanged connections. The rider may include a bearing assembly, a housing seal assembly, one or more strippers, and a catch sleeve. The rider may be selectively longitudinally and torsionally connected to the housing by engagement of the latch with the catch sleeve. The housing may have hydraulic ports in fluid communication with the piston and an interface of the RCD 26. The bearing assembly may support the strippers from the sleeve such that the strippers may rotate relative to the housing (and the sleeve). The bearing assembly may include one or more radial bearings, one or more thrust bearings, and a self contained lubricant system. The bearing assembly may be disposed between the strippers and be housed in and connected to the catch sleeve, such as by a threaded connection and/or fasteners.

Each stripper may include a gland or retainer and a seal. Each stripper seal may be directional and oriented to seal against the drill pipe 10*p* in response to higher pressure in the riser 25 than the UMRP 20. Each stripper seal may have a conical shape for fluid pressure to act against a respective tapered surface thereof, thereby generating sealing pressure against the drill pipe 10*p*. Each stripper seal may have an inner diameter slightly less than a pipe diameter of the drill pipe 10*p* to form an interference fit therebetween. Each stripper seal may be flexible enough to accommodate and seal against threaded couplings of the drill pipe 10*p* having a larger tool joint diameter. The drill pipe 10*p* may be received through a bore of the rider so that the stripper seals may engage the drill pipe. The stripper seals may provide a desired barrier in the riser 25 either when the drill pipe 10*p* is stationary or rotating. The RCD 26 may be submerged adjacent the waterline 2*s*. The RCD interface may be in fluid communication with an auxiliary hydraulic power unit (HPU) (not shown) of the PLC 75 via an auxiliary umbilical 71.

Alternatively, an active seal RCD may be used. Alternatively, the RCD 26 may be located above the waterline 2*s* and/or along the UMRP 20 at any other location besides a lower end thereof. Alternatively, the RCD 26 may be assembled as part of the riser 25 at any location therealong or as part of the PCA 1*p*.

The fluid handling system 1*h* may include a return line 29, mud pump 30*d*, one or more hydraulic power units (HPUs) 30*h* (one shown in FIG. 1A and two shown in FIG. 5B), a bypass line 31*p,h*, one or more hydraulic lines 31*c*, a drain line 32, a solids separator, such as a shale shaker 33, one or more flow meters 34*b,d,r*, one or more pressure sensors 35*b, d,r*, one or more variable choke valves, such as chokes 36*f,p,r*, a supply line, one or more shutoff valves 38*a-d*, a hydraulic manifold 39, and a clamp 200.

A lower end of the return line 29 may be connected to an outlet of the RCD 26 and an upper end of the return line may be connected to an inlet of the shaker 33. The returns pressure sensor 35*r*, returns choke 36*r*, and returns flow meter 34*r* may be assembled as part of the return line 29. A transfer line 61 may connect an outlet of the shaker 33 to an inlet of the mud pump 30*d*. A lower end of the supply line may be connected to an outlet of the mud pump 30*d* and an upper end of the supply line may be connected to the top drive inlet 5*i*. The supply pressure sensor 35*d*, supply flow meter 34*d*, and supply shutoff valve 38*a* may be assembled as part of the supply line. A first end of the bypass line 31*p,h* may be connected to an outlet of the mud pump 30*d* and a second end of the bypass line may be connected to an inlet 207 (FIG. 3A) of the clamp 200. The bypass pressure sensor 35*b*, bypass flow meter 34*b*, and bypass shutoff valve 38*b* may be assembled as part of the bypass line 31*p,h*.

A first end of the drain line 32 may be connected to the transfer line 61 and a second portion of the drain line may have prongs (four shown). A first drain prong may be connected to the bypass line 31*p,h*. A second drain prong may be connected to the supply line. Third and fourth drain prongs may be connected to an outlet of the mud pump 30*d*. The supply drain valve 38*c*, bypass drain valve 38*d*, pressure choke 36*p*, and flow choke 36*f* may be assembled as part of the drain line 32. A first end of the hydraulic lines 31*c* may be connected to the HPU 30*h* and a second end of the hydraulic lines may be connected to the clamp 200. The hydraulic manifold 39 may be assembled as part of the hydraulic lines 31*c*.

Each choke 36*f,p,r* may include a hydraulic actuator operated by the PLC 75 via the auxiliary HPU (not shown). The returns choke 36*r* may be operated by the PLC 75 to maintain backpressure in the riser 25. The flow choke 36*f* may be operated by the PLC 75 to prevent a flow rate supplied to the flow sub 100 and clamp 200 in bypass mode from exceeding a maximum allowable flow rate of the flow sub and/or clamp. Alternatively, the choke actuators may be electrical or pneumatic. The pressure choke 36*p* may be operated by the PLC 75 to protect against overpressure of the clamp 200 by the mud pump 30*d*. Each shutoff valve 38*a-d* may be automated and have a hydraulic actuator (not shown) operable by the PLC 75 via the auxiliary HPU. Alternatively, the valve actuators may be electrical or pneumatic.

Each pressure sensor 35*b,d,r* may be in data communication with the PLC 75. The returns pressure sensor 35*r* may be operable to measure backpressure exerted by the returns choke 36. The supply pressure sensor 35*d* may be operable to measure standpipe pressure. The bypass pressure sensor 35*b* may be operable to measure pressure of the clamp inlet 207. The returns flow meter 34*r* may be a mass flow meter, such as a Coriolis flow meter, and may be in data communication with the PLC 75. The returns flow meter 34*r* may be connected in the return line 29 downstream of the returns choke 36*r* and may be operable to measure a flow rate of the returns 60*r*. Each of the supply 34*d* and bypass 34*b* flow meters may be a volumetric flow meter, such as a Venturi flow meter. The supply flow meter 34*d* may be operable to measure a flow rate of drilling fluid supplied by the mud pump 30*d* to the drill string 10 via the top drive 5. The bypass flow meter 34*b* may be operable to measure a flow rate of drilling fluid supplied by the mud pump 30*d* to the clamp inlet 207. The PLC 75 may receive a density measurement of the drilling fluid 60*d* from a mud blender (not shown) to determine a mass flow rate of the drilling fluid. Alternatively, the bypass 34*b* and supply 34*d* flow meters may each be mass flow meters.

In the drilling mode, the mud pump 30*d* may pump drilling fluid 60*d* from the transfer line 61 (or fluid tank connected thereto), through the pump outlet, standpipe 37*p* and Kelly hose 37*h* to the top drive 5. The drilling fluid 60*d* may include a base liquid. The base liquid may be base oil, water, brine, or a water/oil emulsion. The base oil may be diesel, kerosene, naphtha, mineral oil, or synthetic oil. The drilling fluid 60*d* may further include solids dissolved or suspended in the base liquid, such as organophilic clay, lignite, and/or asphalt, thereby forming a mud.

The drilling fluid 60*d* may flow from the Kelly hose 37*h* and into the drill string 10 via the top drive 5 and flow sub 100. The drilling fluid 60*d* may flow down through the drill string 10 and exit the drill bit 15, where the fluid may circulate the cuttings away from the bit and return the cuttings up an annulus 95 formed between an inner surface of the casing 91 or wellbore 90 and an outer surface of the drill string 10. The returns 60*r* (drilling fluid 60*d* plus cuttings) may flow through the annulus 95 to the wellhead 50. The returns 60*r* may continue from the wellhead 50 and into the riser 25 via the PCA 1*p*. The returns 60*r* may flow up the riser 25 to the RCD 26. The returns 60*r* may be diverted by the RCD 26 into the return line 29 via the RCD outlet. The returns 60*r* may continue through the returns choke 36*r* and the flow meter 34*r*. The returns 60*r* may then flow into the shale shaker 33 and be processed thereby to remove the cuttings, thereby completing a cycle. As the drilling fluid 60*d* and returns 60*r* circulate, the drill string 10 may be rotated 16 by the top drive 5 and lowered by the traveling block 6, thereby extending the wellbore 90 into the lower formation 94*b*.

The PLC 75 may be programmed to operate the returns choke 36*r* so that a target bottomhole pressure (BHP) is maintained in the annulus 95 during the drilling operation. The target BHP may be selected to be within a drilling window defined as greater than or equal to a minimum threshold pressure, such as pore pressure, of the lower formation 94*b* and less than or equal to a maximum threshold pressure, such as fracture pressure, of the lower formation, such as an average of the pore and fracture BHPs. Alternatively, the minimum threshold may be stability pressure and/or the maximum threshold may be leakoff pressure. Alternatively, threshold pressure gradients may be used instead of pressures and the gradients may be at other depths along the lower formation 94*b* besides bottomhole, such as the depth of the maximum pore gradient and the depth of the minimum fracture gradient. Alternatively, the PLC 75 may be free to vary the BHP within the window during the drilling operation.

A static density of the drilling fluid 60*d* (typically assumed equal to returns 60*r*; effect of cuttings typically assumed to be negligible) may correspond to a threshold pressure gradient of the lower formation 94*b*, such as being greater than or equal to a pore pressure gradient. During the drilling operation, the PLC 75 may execute a real time simulation of the drilling operation in order to predict the actual BHP from measured data, such as standpipe pressure from sensor 35*d*, mud pump flow rate from the supply flow meter 34*d*, wellhead pressure from an of the sensors 47*a-c*, and return fluid flow rate from the return flow meter 34*r*. The PLC 75 may then compare the predicted BHP to the target BHP and adjust the returns choke 36*r* accordingly.

During the drilling operation, the PLC 75 may also perform a mass balance to monitor for instability of the lower formation 94*b*, such as a kick (not shown) or lost circulation (not shown). As the drilling fluid 60*d* is being pumped into the wellbore 90 by the mud pump 30*d* and the returns 60*r* are being received from the return line 29, the PLC 75 may compare the mass flow rates (i.e., drilling fluid flow rate minus returns flow rate) using the respective flow meters 34*d,r*. The PLC 75 may use the mass balance to monitor for formation fluid (not shown) entering the annulus 95 and contaminating the returns 60*r* or returns 60*r* entering the formation 94*b*.

Upon detection of instability, the PLC 75 may take remedial action, such as diverting the flow of returns 60*r* from an outlet of the returns flow meter to a degassing spool (not shown). The degassing spool may include automated shutoff valves at each end, a mud-gas separator (MGS), and a gas detector. A first end of the degassing spool may be connected to the returns line 29 between the returns flow meter 34*r* and the shaker 33 and a second end of the degasser spool may be connected to an inlet of the shaker. The gas detector may include a probe having a membrane for sampling gas from the returns 60*r*, a gas chromatograph, and a carrier system for delivering the gas sample to the chromatograph. The MGS may include an inlet and a liquid outlet assembled as part of the degassing spool and a gas outlet connected to a flare or a gas storage vessel. The PLC 75 may also adjust the returns choke 36*r* accordingly, such as tightening the choke in response to a kick and loosening the choke in response to loss of the returns.

Alternatively, the PLC 75 may include other factors in the mass balance, such as displacement of the drill string and/or cuttings removal. The PLC 75 may calculate a rate of penetration (ROP) of the drill bit 15 by being in communication with the drawworks 9 and/or from a pipe tally. A mass flow meter may be added to the cuttings chute of the shaker 33 and the PLC 75 may directly measure the cuttings mass rate.

Additionally, the PLC may monitor for other instability issues, such as differential sticking and/or collapse of the wellbore 90 by being in data communication with the top drive 5 for receiving torque exerted by the top drive and/or angular speed of the quill 5*q*.

Figure 2A:
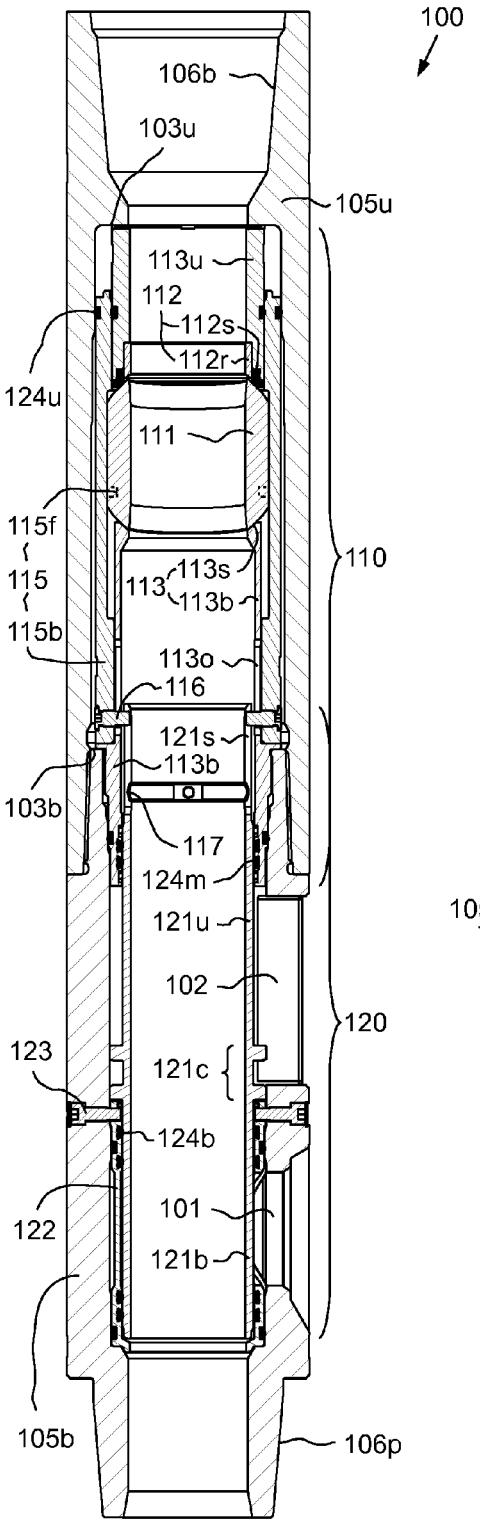
FIG. 2A illustrates a flow sub of the drilling system in a top injection mode.
Figure 2B:
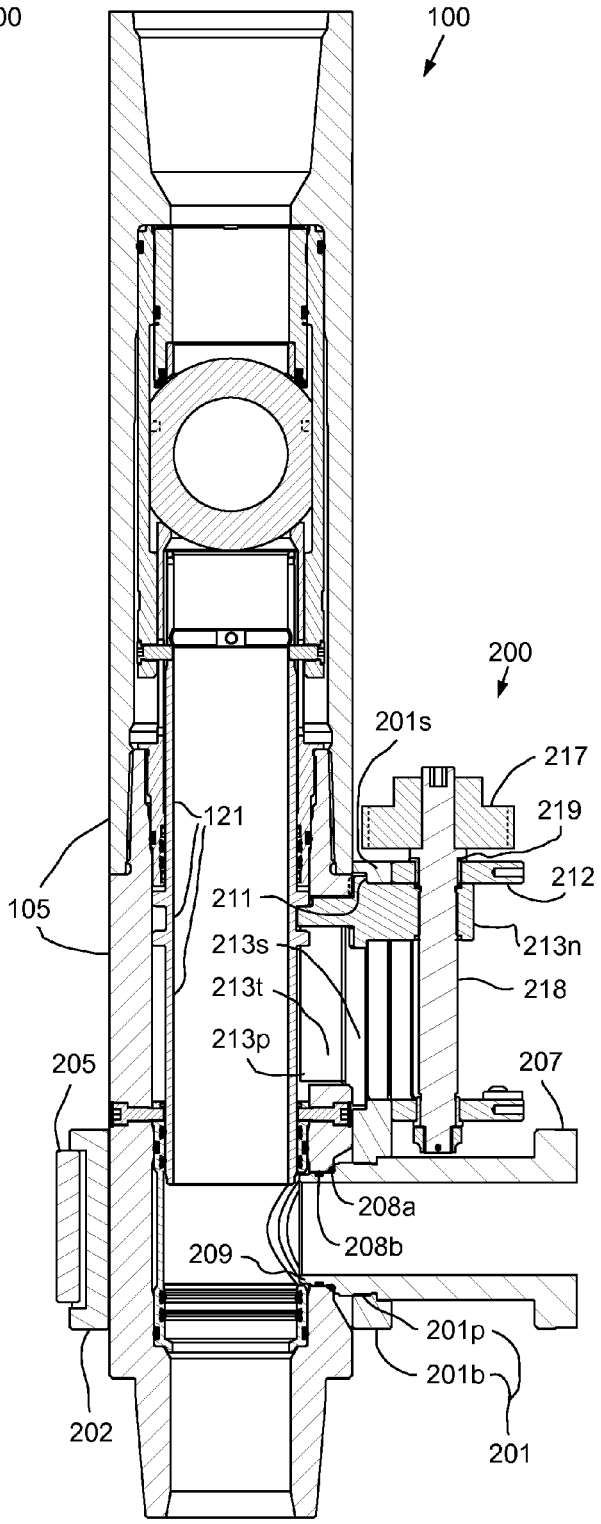
FIG. 2B illustrates the flow sub shifted to a side injection mode by a clamp of the drilling system.

FIG. 2A illustrates the flow sub 100 in a top injection mode. FIG. 2B illustrates the flow sub 100 shifted to a side injection mode by the clamp 200. The flow sub 100 may include a tubular housing 105, a bore valve 110, a bore valve actuator, and a side port valve 120. The housing 105 may include one or more sections, such as an upper section 105*u* and a lower 105*b* section, each section connected together, such as by a threaded connection. An outer diameter of the housing 105 may correspond to the tool joint diameter of the drill pipe 10*p* to maintain compatibility with the RCD 26. The housing 105 may have a central longitudinal bore formed therethrough and a radial flow port 101 formed through a wall thereof in fluid communication with the bore (in this mode) and located at a side of the lower housing section 105*b*. The housing 105 may also have a threaded coupling at each longitudinal end, such as box 106*b* formed in an upper longitudinal end and a pin 106*p* formed on a lower longitudinal end, so that the housing may connect a top of the drill string 10 to the quill 5*q*. Except for seals and where otherwise specified, the flow sub 100 may be made from a metal or alloy, such as steel, stainless steel, or a nickel based alloy. Seals may be made from a polymer, such as a thermoplastic, elastomer, or copolymer and may or may not be housed in a gland.

The bore valve 110 may include a closure member, such as a ball 111, a seat 112, and a body, such as a cage 113. The cage 113 may include one or more sections, such as an upper section 113*u* and a lower 113*b* section. The lower cage section 113*b* may be disposed within the housing 105 and connected thereto, such as by a threaded connection and engagement with a lower shoulder 103*b* of the housing 105. The upper cage section 113*u* may be disposed within the housing 105 and connected thereto, such as by entrapment between the ball 111 and an upper shoulder 103*u* of the housing. The upper shoulder 103*u* may be formed in an inner surface of the upper housing section 105*u* and the lower shoulder 103*b* may be a top of the lower housing section 105*b*. The seat 112 may include a seal 112*s* and a retainer 112*r*. The seat retainer 112*r* may be connected to the upper cage section 113*u*, such as by a threaded connection. The seat seal 112*s* may be connected to the upper cage section 113*u*, such as by a lip and groove connection and by being disposed between the upper cage section and the seat retainer 112*r*. A top of the lower cage section 113*b* may serve as a stopper 113*s* for the ball 111.

The ball 111 may be disposed between the cage sections 113*u,b* and may be rotatable relative thereto. The ball 111 may be operable between an open position (FIG. 2A) and a closed position (FIGS. 2B and 5B) by the bore valve actuator. The ball 111 may have a bore formed therethrough corresponding to the housing bore and aligned therewith in the open position. A wall of the ball 111 may close an upper portion of the housing bore in the closed position and the ball 111 may engage the seat seal 112*s* in response to pressure exerted against the ball by fluid injection into the side port 101.

The port valve 120 may include a closure member, such as a sleeve 121, and a seal mandrel 122. The seal mandrel 122 may be made from an erosion resistant material, such as tool steel, ceramic, or cermet. The seal mandrel 122 may be disposed within the housing 105 and connected thereto, such as by one or more (two shown) fasteners 123. The seal mandrel 122 may have a port formed through a wall thereof corresponding to and aligned with the side port 101. Lower seals 124*b* may be disposed between the housing 105 and the seal mandrel 122 and between the seal mandrel and the sleeve 121 to isolate the interfaces thereof. The port valve 120 may have a maximum allowable flow rate greater than, equal to, or slightly less than a flow rate of the drilling fluid 60*d* in drilling mode.

The sleeve 121 may be disposed within the housing 105 and longitudinally moveable relative thereto between an open position (FIGS. 2B and 5B) and a closed position (FIG. 2A) by the clamp 200. In the open position, the side port 101 may be in fluid communication with a lower portion of the housing bore. In the closed position, the sleeve 121 may isolate the side port 101 from the housing bore by engagement with the lower seals 124*b* of the seal sleeve 122. The sleeve may include an upper portion 121*u*, a lower portion 121*b*, and a lug 121*c* disposed between the upper and lower portions.

A window 102 may be formed through a wall of the lower housing section 105*b* and may extend a length corresponding to a stroke of the port valve 120. The window 102 may be aligned with the side port 101. The lug 121*c* may be accessible through the window 102. A recess 104 may be formed in an outer surface of the lower housing section 105*b* adjacent to the side port 101 for receiving a stab connector 209 formed at the clamp inlet 207. Mid seals 124*m* may be disposed between the housing 105 and the lower cage section 113*b* and between the lower cage section and the sleeve 121 to isolate the interfaces thereof.

The bore valve actuator may be mechanical and include a cam 115, a linkage, such as one or more (two shown) pins 116 and slots 121*s*, and a toggle, such as a split ring 117. An upper annulus may be formed between the cage 113 and the upper housing section 105*u* and a lower annulus may be formed between the valve sleeve 121 and the lower housing section 105*b*. The cam 115 may be disposed in the upper annulus and may be longitudinally movable relative to the housing 105. The cam 115 may interact with the ball 111, such as by having one or more (two shown) followers 115*f*, each formed in an inner surface of a body 115*b* thereof and extending into a respective cam profile (not shown) formed in an outer surface of the ball 111 or vice versa. Alternatively, each follower 115*f* may be a separate member fastened to the cam body 115*b*. The ball-cam interaction may rotate the ball 111 between the open and closed positions in response to longitudinal movement of the cam 115 relative to the ball.

The cam 115 may also interact with the valve sleeve 121 via the linkage. The pins 116 may each be fastened to the cam body 115*b* and each extend into the respective slot 121*s* formed through a wall of the sleeve upper portion 121*u* or vice versa. The split ring 117 may be fastened to the sleeve 121 by being received in a groove formed in an inner surface of the sleeve upper portion 121*u* at a lower portion of the slots 121*s*. The lower cage section 113*b* may have an opening 113*o* formed therethrough for accommodating the cam-sleeve interaction. The linkage may longitudinally connect the cam 115 and the sleeve 121 after allowing a predetermined amount of longitudinal movement therebetween. A stroke of the cam 115 may be less than a stroke of the sleeve 121, such that when coupled with the lag created by the linkage, the bore valve 110 and the port valve 120 may never both be fully closed simultaneously. Upper seals 124*u* may be disposed between the housing 105 and the cam 115 and between the upper cage section 113*u* and the cam to isolate the interfaces thereof.

Figure 3A:
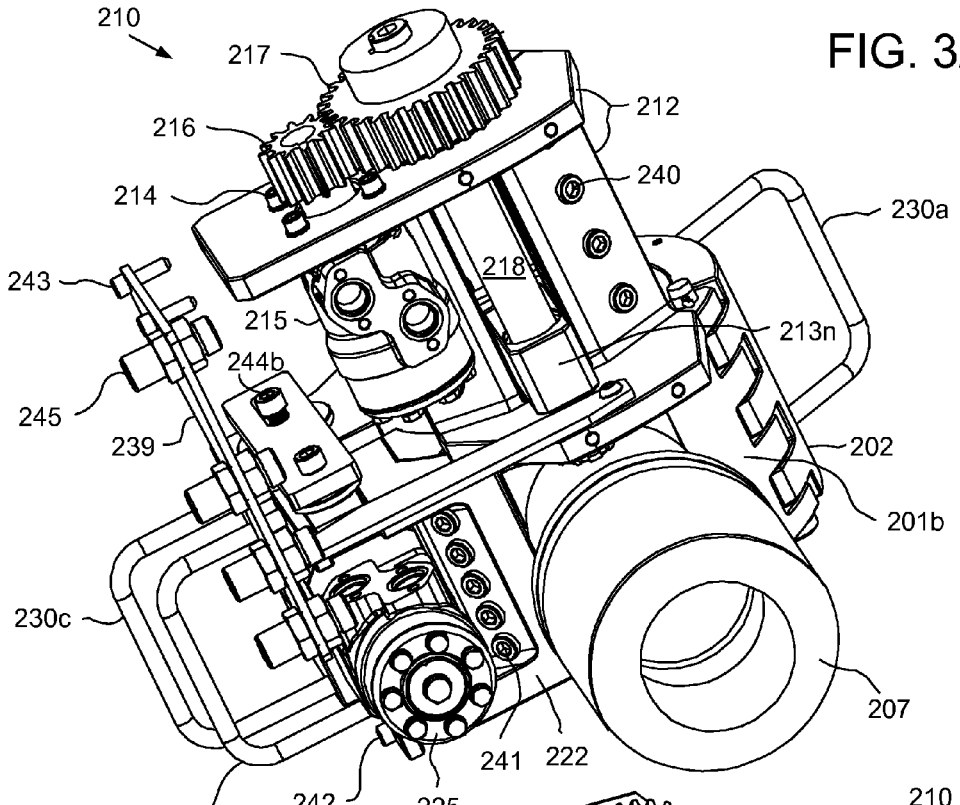
FIGS. 3A and 3B illustrate the clamp of the drilling system.
Figure 3B:
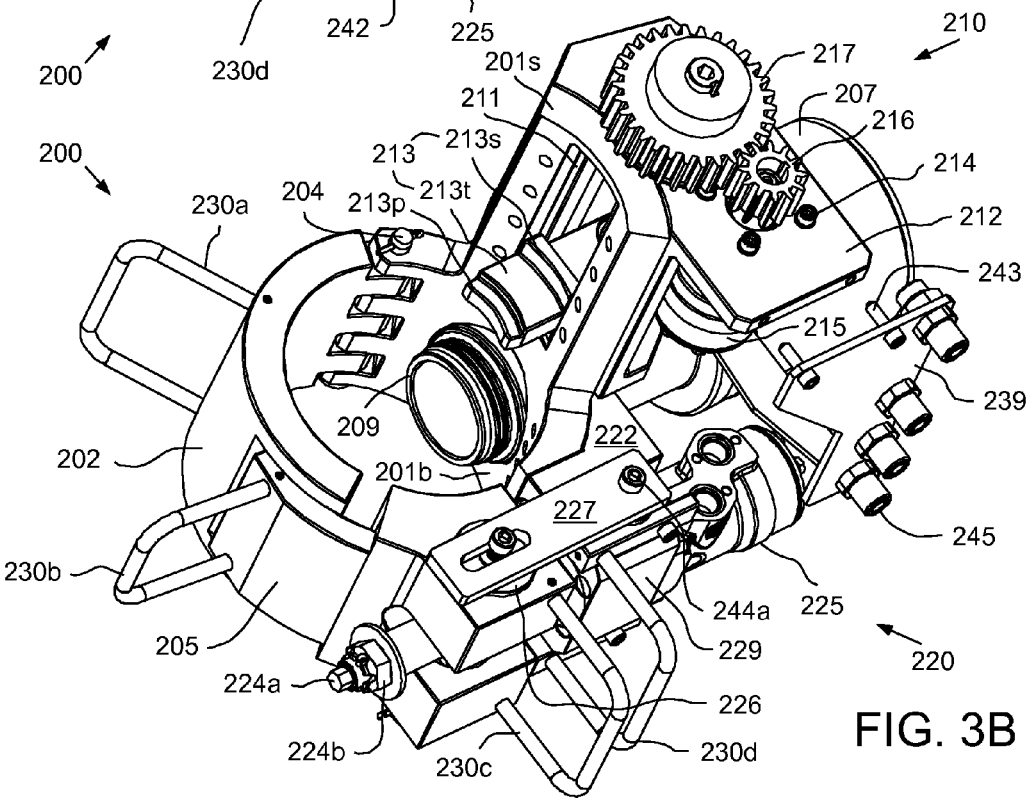

FIGS. 3A and 3B illustrate the clamp 200. The clamp 200 may include a body 201, a band 202, a latch 205 operable to fasten the band to the body, an inlet 207, one or more actuators, such as port valve actuator 210 and a band actuator 220, and a hub 239. The clamp 200 may be movable between an open position (not shown) for receiving the flow sub 100 and a closed position for surrounding an outer surface of the lower housing segment 105*b*. The body 201 may have a lower base portion 201*b* and an upper stem portion 201*s*. The body 201 may have a coupling, such as a hinge portion, formed at an end of the base portion 201*b*, and the band 202 may have a mating coupling, such as a hinge portion, formed at a first end thereof. The hinge portions may be connected by a fastener, such as a pin 204, thereby pivotally connecting the band 202 and the body 201. The band 202 may have a lap formed at a second end thereof for mating with a complementary lap formed at an end of the latch 205. Engagement of the laps may form a lap joint to circumferentially connect the band 202 and the latch 205.

The body 201 may have a port 201*p* formed through the base portion 201*b* for receiving the inlet 207. The inlet 207 may be connected to the body 201, such as by a threaded connection. A mud saver valve (MSV) 238 (FIG. 5B) may be connected to the inlet 207, such as by a threaded connection. An adapter (not shown) may be connected to the MSV 238, such as by a threaded connection. The adapter may have a coupling, such as flange, for receiving a flexible conduit, such as bypass hose 31*h*. The inlet 207 may further have one or more seals 208*a,b* and the stab connector 209 formed at an end thereof engaging a seal face of the flow sub 100 adjacent to the side port 101.

The port valve actuator 210 may include the stem portion 201*s*, a bracket 212, a yoke 213, a hydraulic motor 215, and a gear train 216, 217. The body 201 may have a window formed through the stem portion 201*s* and guide profiles, such as tracks 211, formed in an inner surface of the stem portion adjacent to the window. The yoke 213 may extend through the window and have a nut portion 213*n*, slider portion 213*s*, and tongue portion 213*t*. The slider portion 213*s* may be engaged with the tracks 211, thereby allowing longitudinal movement of the yoke 213 relative to the body 201. The yoke 213 may have an engagement profile, such as a lip 213*p*, formed at an end of the tongue portion 213*t* for engaging a groove formed in an outer surface of the lug 121*c*, thereby longitudinally connecting the yoke with the flow sub sleeve 121. The hydraulic motor 215 may have a stator connected to the bracket 212, such as by one or more (four shown) fasteners 214, and a rotor connected to a drive gear 216 of the gear train 216, 217. The motor 215 may be bidirectional.

The drive gear 216 may be connected to a yoke gear 217 by meshing of teeth thereof. The yoke gear 217 may be connected to a lead screw 218, such as by interference fit or key/keyway. The nut portion 213*n* may be engaged with the lead screw 218 such that the yoke 213 may be being raised and lowered by respective rotation of the lead screw. The bracket 212 may be connected to the body 201, such as by one or more (three shown) fasteners 240. The lead screw 218 may be supported by the bracket 212 for rotation relative thereto by one or more bearings 219. The motor 215 may be operable to raise and lower the yoke 213 relative to the body 201, thereby also operating the flow sub sleeve 121 when the clamp 200 is engaged with the flow sub 100. Alternatively, the motor 215 may be electric or pneumatic.

The band actuator 220 may be operable to tightly engage the clamp 200 with the lower housing section 105*b* after the latch 105 has been fastened. The band actuator 220 may include a bracket 222, a hydraulic motor 225, a bearing 229, and a tensioner. The tensioner may include a tensioner bolt 224*a*, a stopper 224*b*, and a tubular tensioner nut 226. The motor 225 may have a stator connected to the bearing 229, such as by one or more fasteners (not shown) and a rotor connected to a tensioner bolt 224*a*. The motor 225 may be bidirectional. The tensioner bolt 224*a* may be supported from the body 201 for rotation relative thereto by the bearing 229. The bracket 222 may be connected to the body 201, such as by one or more (five shown) fasteners 241. The bearing 229 may be connected to the bracket 222, such as by a fastener 242.

The latch 205 may include an opening formed therethrough for receiving the tensioner nut 226 and a cavity formed therein for facilitating assembly of the tensioner. To further facilitate assembly, the tensioner nut 226 may be connected to a bar 227, such as by fastener 244*b* and a pin (slightly visible in FIG. 3B). The bar 227 may have a slot formed therethrough to accommodate operation of the tensioner. The bar 227 may also be connected to the bracket, such as by fastener 244*a*. The tensioner nut 226 may rotate relative to the opening and may have a threaded bore for receiving the tensioner bolt 224*a*. Rotation of the tensioner nut 226 may prevent binding of the tensioner bolt 224*a* and may allow replacement due to wear. The stopper 224*b* may be connected to the bolt 224*a* with a threaded connection. To engage the clamp 200 with the flow sub 100, the body 201 may be aligned with the flow sub 100, the band 202 wrapped around the flow sub 100 and the latch 205 engaged with the band 202. The motor 225 may then be operated, thereby tightening the clamp 200 around the lower housing section 105*b*. Alternatively, the motor 225 may be electric or pneumatic.

To facilitate manual handling, the clamp 200 may further include one or more handles 230*a-d*. A first handle 230*a* may be connected to the band 202, such as by a fastener. Second 230*b* and third 230*c* handles may be connected to the latch 205, such as by respective fasteners. A fourth handle 230*d* may be connected to the bracket 222, such as by a fastener. A hub 239 may be connected to the bracket 212, such as by one or more (two shown) fasteners 243. The hub 239 may include one or more (four shown) hydraulic connectors 245 for receiving respective hydraulic lines 31*c* from the hydraulic manifold 39. The hub 239 may also include internal hydraulic conduits (not shown), such as tubing, connecting the connectors 245 to respective inlets and outlets of the hydraulic motors 215, 225.

Each hydraulic motor 215, 225 may further include a motor lock operable between a locked position and an unlocked position. Each motor lock may include a clutch torsionally connecting the respective rotor and the stator in the locked position and disengaging the respective rotor from the respective stator in the unlocked position. Each clutch may be biased toward the locked position and further include an actuator, such as a piston, operable to move the clutch to the unlocked position in response to hydraulic fluid being supplied to the respective motor.

FIGS. 4A-4H illustrate adding a stand 11*a* of drill pipe 10*p* to the drill string 10 in drilling mode. If no instability has been detected, the drill string 10 may be extended in the drilling mode once a top of the drill string 10 reaches the rig floor 4. Drilling may be stopped by stopping advancement and rotation 16 of the top drive and removing weight from the drill bit 15. A spider 19 may then be operated to engage the drill string 10, thereby longitudinally supporting the drill string 10 from the rig floor 4. A drive tong 65*d* may be engaged with the flow sub 100 and a backup tong 65*b* may be engaged with the top of the drill string 10. The first top drive thread compensator may be operated to accommodate longitudinal movement of the threaded connection between the flow sub 100 and the drill string 10.

The drive tong 65*d* may then be operated to loosen the connection between the flow sub 100 and the drill string 10. Once the connection has been loosened, the drive tong 65*d* may be disengaged from the flow sub 100 and the top drive motor 5*m* may be operated to finish unscrewing the connection. The top drive 5 may then be raised until the elevator 5*e* is proximate to a top of the stand 11*a*. The elevator 5*e* may be opened (or already open), engaged with the stand 11*a* and closed to securely grip the stand. The top drive 5 and stand 11*a* may then be raised and the link-tilt operated to swing the stand into alignment with the drill string 10. The top drive 5 and stand 11*a* may be lowered and a bottom coupling of the stand stabbed into the top coupling of the drill string 10.

The top drive first thread compensator may again be operated and a spinner (not shown) may be engage with the stand 11*a* and operated to spin the connection between the stand 11*a* and the drill string 10. The drive tong 65*d* may be engaged with the bottom coupling and the backup tong 65*b* may still be engaged with the top coupling of the drill string 10. The drive tong 65*d* may then be operated to tighten the connection between the stand 11*a* and the drill string 10. Once the connection has been tightened, the tongs 65*d,b* may be disengaged. The elevator 5*e* may be partially opened to release the stand 11*a* and the top drive 5 lowered relative to the stand. The backup wrench arm actuator may be operated to lower the tong to a position adjacent a top coupling of the stand 11*a*. The tong actuator may then be operated to engage the backup wrench tong with the top coupling of the stand 11*a*, the elevator 5*e* may be fully opened, and the link-tilt operated to clear the elevator. The arm actuator may then be operated as the second thread compensator and the top drive motor 5*m* operated to spin and tighten the connection between the flow sub 100 and the stand 11*a*.

The spider 19 may then be operated to release the drill string 10. Once released, the top drive motor 5*m* may be operated to rotate 16 the drill string 10. Weight may be added to the drill bit 15, thereby advancing the drill string 10 into the wellbore 90 and resuming drilling of the wellbore. The process may be repeated until the wellbore 90 has been drilled to total depth or a depth for setting another string of casing, or instability is detected.

Figure 5A:
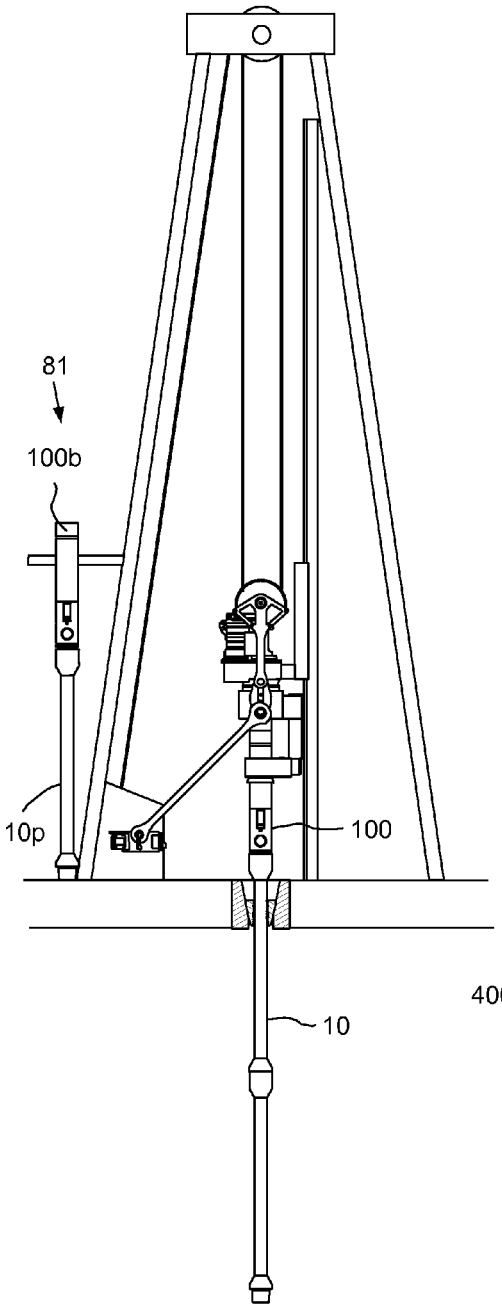
FIGS. 5A and 5B illustrate extending the drill string in bypass mode.
Figure 5B:
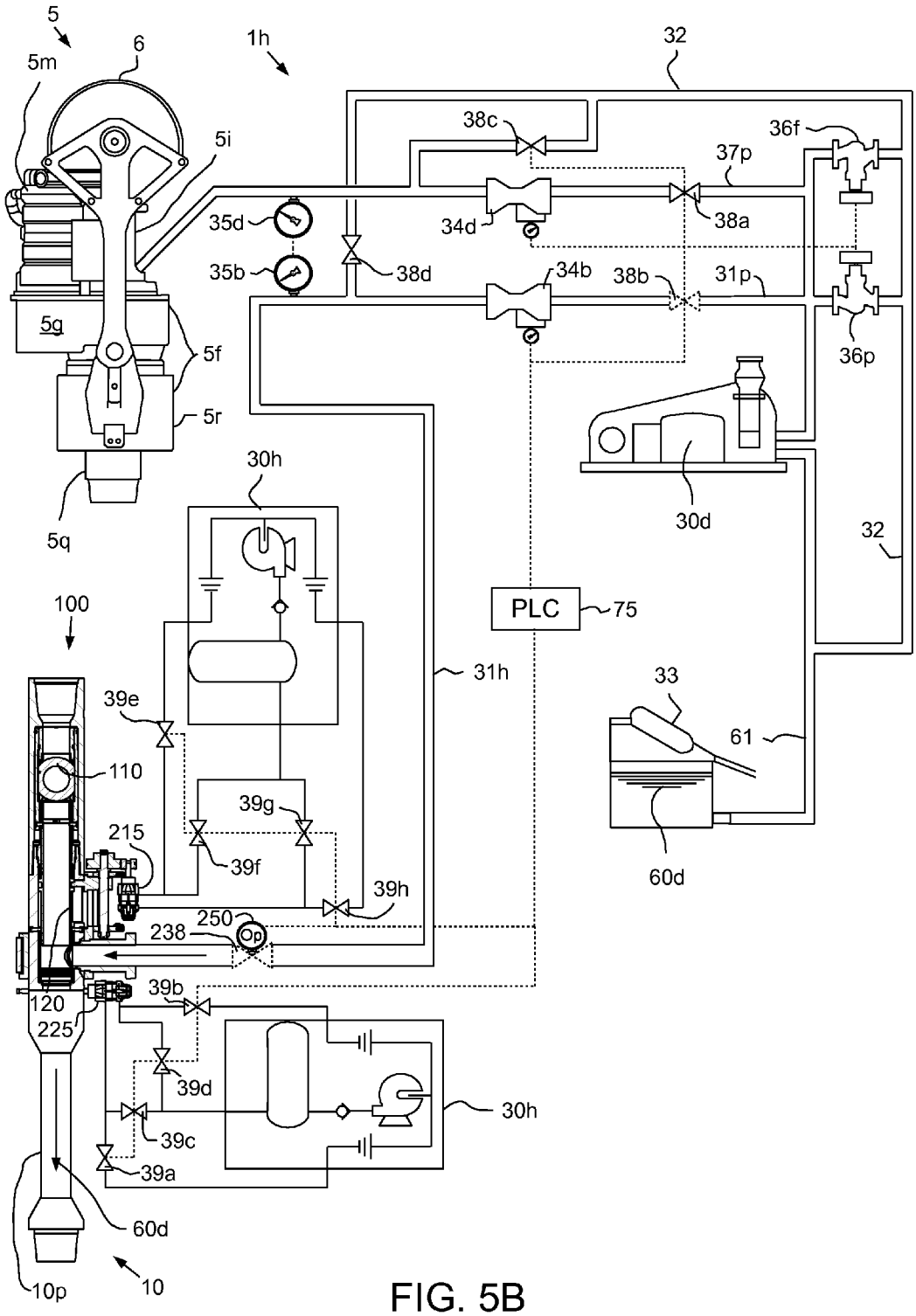

FIGS. 5A and 5B illustrate extending the drill string 10 in bypass mode. If instability has been detected, the drill string 10 may be extended in bypass mode once the top of the drill string 10 reaches the rig floor 4. In preparation of the shift, the stand 11*b* may be replaced by a modified stand 81. The modified stand 81 may include a second continuous flow sub 100*b* and one or more joints of drill pipe 10*p*. Drilling may be stopped by stopping advancement and rotation 16 of the top drive 5 and removing weight from the drill bit 15. The spider 19 may then be operated to engage the drill string 10, thereby longitudinally supporting the drill string 10 from the rig floor 4. The clamp 200 may then be transported to the flow sub 100 and closed around the flow sub lower housing section 105*b*. The PLC 75 may then operate the band actuator 220 by opening manifold valves 39*a,d*, thereby supplying hydraulic fluid to the band motor 225. Operation of the band motor 225 may rotate the tensioner bolt 224*a*, thereby tightening the clamp 200 into engagement with the flow sub lower housing 105*b*. The PLC 75 may then lock the band motor 225. The MSV 238 may be opened and then the rig crew may evacuate the rig floor 4.

A position sensor 250 may be operably coupled to the MSV 238 for determining a position (open or closed) of the MSV. The position sensor 250 may be in data communication with the PLC 75. The fluid handling system 1*h* may further include a second HPU 30*h* and a second manifold 39. Each HPU 30*h* may include a pump, an accumulator, a check valve, a reservoir having hydraulic fluid, and internal hydraulic conduits connecting the pump, reservoir, accumulator, and check valve. Each HPU 30*h* may further include a pressurized port in fluid communication with the respective accumulator and a drain port in fluid communication with the reservoir. Each hydraulic manifold 39 may include one or more automated shutoff valves 39*a-d*, 39*e-h* in communication with the PLC 75. Each manifold 39 may have a pressurized inlet in connected to a first respective pair of the shutoff valves and a drain inlet in fluid communication with a second respective pair of shutoff valves. Each manifold 39 may also have first and second outlets, each outlet connected to a shutoff valve of each pair. A first portion of the hydraulic lines 31*c* may connect respective inlets of the manifolds to respective inlets of the HPUs 30*h*. A second portion of the hydraulic lines 31*c* may connect respective outlets of the manifolds to respective hydraulic connectors 245 of the clamp hub 239. Alternatively, each manifold 39 may include one or more directional control valves, each directional control valve consolidating two or more of the shutoff valves 39*a-h*.

The PLC 75 may then test engagement of the seals 208*a,b* by closing the bypass drain valve 38*d* and by opening the bypass valve 38*b* to pressurize the clamp inlet 207 and then closing the bypass valve. If the clamp seals 208*a,b* are not securely engaged with the lower housing section 105*b*, drilling fluid 60*d* will leak past the clamp seals. The PLC 75 may verify sealing integrity by monitoring the bypass pressure sensor 35*b*. The PLC 75 may then reopen the bypass valve 38*b* to equalize pressure on the valve sleeve 121. The PLC 75 may then operate the port valve actuator 210 by opening manifold valves 39*f,h*, thereby supplying hydraulic fluid to the port motor 215. Operation of the port motor 215 may rotate the lead screw 218, thereby raising the yoke 213.

When moved upwardly by the yoke 213, the sleeve 121 may move longitudinally relative to the cam 115 until the split ring 117 engages the pins 116, thereby longitudinally connecting the sleeve and the cam. Upward movement of the sleeve 121 and the cam 115 may continue, thereby closing the bore valve 110. Drilling fluid 60*d* may momentarily flow into the drill string 10 through both the side port 101 and the bore valve 110. The upward movement may continue until a top of the cam 115 engages the upper housing shoulder 103*u*. The split ring 117 may then be pushed radially inward by further engagement with the pins 116, thereby freeing the cam 115 from the sleeve 121. Upward movement of the sleeve 121 (without the cam 115) may continue until an upper shoulder of the yoke 213 engages an upper shoulder of the stem portion 201*s* at which point the side port 101 is fully open. Once the side port 101 is fully open, the PLC 75 may lock the port motor 215 and relieve pressure from the top drive 5 by closing the supply valve 38*a* and opening the supply drain valve 38*c*. The PLC 75 may then test integrity of the closed bore valve 110 by closing the supply drain valve 38*d*. The PLC 75 may verify closing of the bore valve 110 by monitoring the supply pressure sensor 35*d*.

The tong actuator may then be operated to engage the backup wrench tong with the flow sub 100 and the top drive motor 5m operated to disconnect the quill 5*q* from the flow sub 100. The top drive 5 may then be raised until the elevator 5*e* is proximate to a top of the second flow sub 100*b*. The elevator 5*e* may be opened (or already open), engaged with the second flow sub 100*b* and closed to securely grip the modified stand 81. The top drive 5 and modified stand 81 may then be raised and the link-tilt operated to swing the modified stand into alignment with the drill string 10 and flow sub 100. The rig crew may then return to the rig floor 4. The top drive 5 and modified stand 81 may be lowered and a bottom coupling of the modified stand stabbed into the top coupling 106*b* of the flow sub 100. The top drive first thread compensator may again be operated and the spinner may be operated to spin the connection between the modified stand 81 and the flow sub 100. The drive tong 65*d* and backup tong 65*b* may then be used to tighten the connection. The rig crew may then leave the rig floor 4. The connection between the quill 5*q* and the second flow sub 100*b* may then be made in a similar fashion as discussed above for the connection between the flow sub 100 and the stand 11*a*.

Drilling fluid 60*d* may continue to be injected into the side port 101 (via the open supply valve 38*b* and MSV 238) during adding of the modified stand 81 by the top drive 5 at a flow rate corresponding to the flow rate in drilling mode. The PLC 75 may also utilize the bypass flow meter 34*b* for performing the mass balance to monitor for a kick or lost circulation during adding of the modified stand 81. Once the modified stand 81 has been added to the drill string 10, the PLC 75 may pressurize the added stand 81 by closing the supply drain valve 38*c* and opening the supply valve 38*a*. Once the added stand 81 has been pressurized, the PLC 75 may then unlock the port motor 215. The PLC 75 may then reverse operate the port valve actuator 210 by opening manifold valves 39*e,g*, thereby reversing supply of the hydraulic fluid to the port motor 215. Operation of the port motor 215 may counter-rotate the lead screw 218, thereby lowering the yoke 213.

When moved downwardly by the yoke 213, the sleeve 121 may move longitudinally relative to the cam 115 until the split ring 117 engages the pins 116, thereby longitudinally connecting the sleeve and the cam. Downward movement of the sleeve 121 and the cam 115 may continue, thereby opening the bore valve 110. Drilling fluid 60*d* may momentarily flow into the drill string 10 through both the side port 101 and the bore valve 110. The downward movement may continue until a bottom of the cam 115 engages a shoulder of the lower cage section 113*b*. The split ring 117 may then be pushed radially inward by further engagement with the pins 116, thereby freeing the cam 115 from the sleeve 121. Downward movement of the sleeve 121 (without the cam 115) may continue until a lower shoulder of the yoke 213 engages a lower shoulder of the stem portion 201*s* at which point the side port 101 is fully closed.

Once the side port 101 is fully closed, the PLC 75 may then relieve pressure from the clamp inlet 207 by closing the bypass valve 38*b* and opening the bypass drain valve 38*d*. The PLC 75 may then confirm closure of the port sleeve 121 by closing the bypass drain valve 38*d* and monitoring the bypass pressure sensor 35*b*. Once closure of the port sleeve 121 has been confirmed, the PLC 75 may open the bypass drain valve 38*d*. The rig crew may then return to the rig floor 4 and close the MSV 238. The PLC 75 may then unlock the band motor 225. The PLC 75 may then reverse operate the band actuator 220 by opening manifold valves 39*b,c*, thereby reversing supply of hydraulic fluid to the band motor 225. Operation of the band motor 225 may counter-rotate the tensioner bolt 224*a*, thereby loosening the clamp 200 from engagement with the flow sub lower housing 105*b*. The clamp 200 may then be opened and transported away from the flow sub 100. The spider 19 may then be operated to release the drill string 10. Once released, the top drive 5 may be operated to rotate 16 the drill string 10. Weight may be added to the drill bit 15, thereby advancing the drill string 10 into the wellbore 90 and resuming drilling of the wellbore. The process may be repeated until the wellbore 90 has been drilled to total depth or to a depth for setting another string of casing.

Alternatively, power tongs (not shown) may be used to add the modified stand 81 to the drill string instead of the rig crew returning to operate the tongs 65*d,b* and the spinner.

Figure 6A:
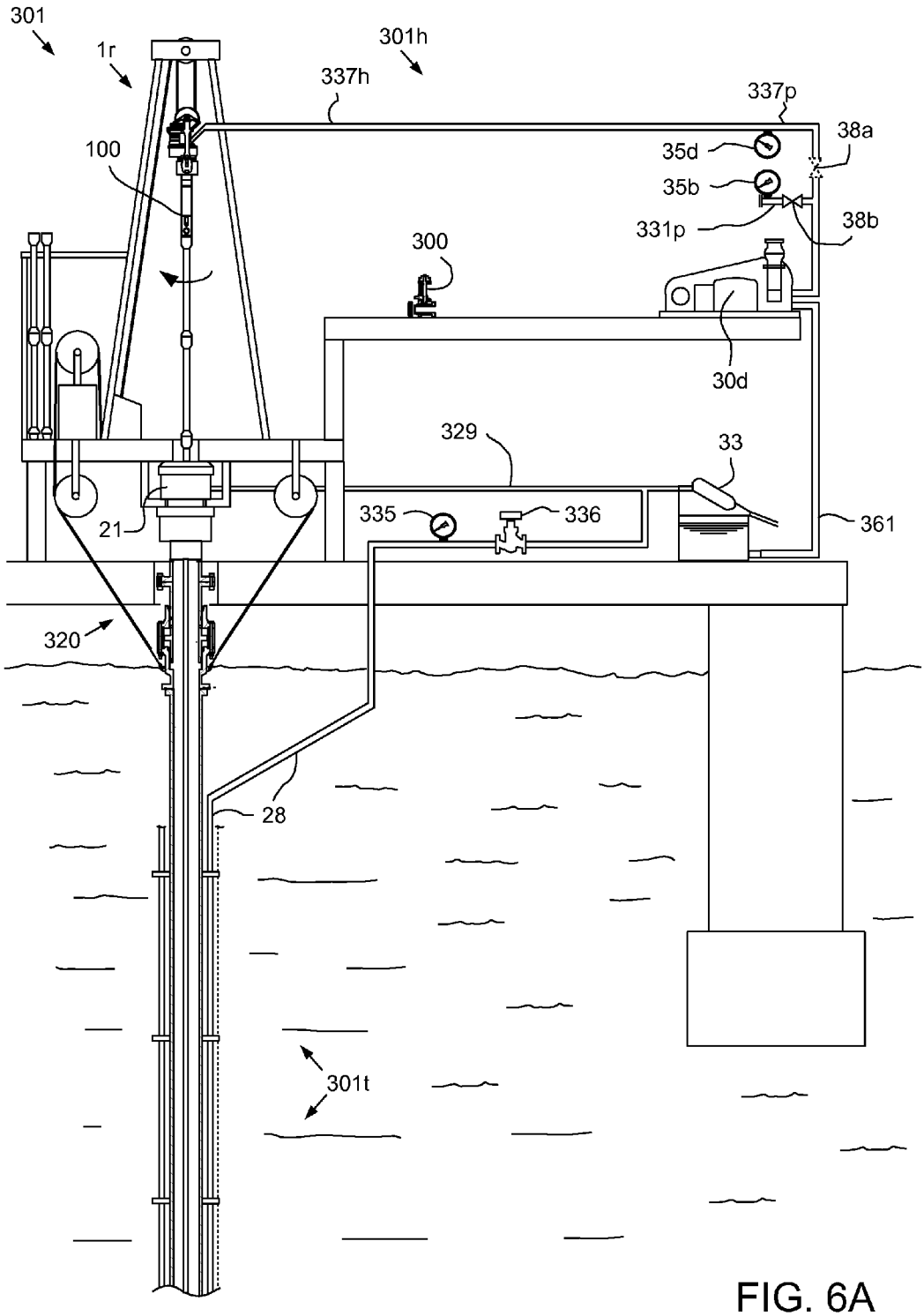
FIG. 6A illustrates an alternative drilling system in the drilling mode, according to another embodiment of the present invention.

FIG. 6A illustrates an alternative drilling system 301 in the drilling mode, according to another embodiment of the present invention. The drilling system 301 may include the MODU 1*m*, the drilling rig 1*r*, a fluid handling system 301*h*, a fluid transport system 301*t*, and the PCA (not shown, see PCA 1*p*). The fluid transport system 301*t* may include the drill string 10, an upper marine riser package (UMRP) 320, the marine riser 25, the booster line 27, and the choke line 28. The UMRP 320 may include the diverter 21, the flex joint 22, the slip joint 23, and the tensioner 24. A lower end of the slip joint 23 may be connected to the upper end of the riser 25, such as by a flanged connection.

The fluid handling system 301*h* may include a return line 329, the mud pump 30*d*, a bypass spool 331*p*, the shale shaker 33, the pressure sensors 35*b,d*, a pressure gauge 335, a rig choke 336, a supply line, the shutoff valves 38*a,b*, and a clamp 300. A first end of the return line 329 may be connected to an outlet of the diverter 21 and a second end of the return line may be connected to the inlet of the shaker 33. An upper end of the choke line 28 may be connected to the return line 329 or to the shaker inlet. The rig choke 336 and pressure gauge 335 may be assembled as part of the choke line 28. A transfer line 361 may connect the outlet of the shaker 33 to the inlet of the mud pump 30*d*. A lower end of the supply line may be connected to the outlet of the mud pump 30*d* and an upper end of the supply line may be connected to the top drive inlet 5*i*. The supply pressure sensor 35*d* and supply shutoff valve 38*a* may be assembled as part of the supply line. A first end of the bypass spool 331*p* may be connected to the outlet of the mud pump 30*d* and a second end of the bypass spool may be blind flanged in the drilling mode. The bypass pressure sensor 35*b* and bypass shutoff valve 38*b* may be assembled as part of the bypass spool 331*p*. The umbilical 70 and the pressure sensors 35*b,d* may be in communication with a rig controller (not shown).

In the drilling mode, the mud pump 30*d* may pump the drilling fluid 60*d* from the transfer line 361 (or fluid tank connected thereto), through the pump outlet, standpipe 337*p* and Kelly hose 337*h* to the top drive 5. The drilling fluid 60*d* may flow from the Kelly hose 337*h* and into the drill string 10 via the top drive 5 and flow sub 100. The drilling fluid 60*d* may flow down through the drill string 10 and exit the drill bit 15, where the fluid may circulate the cuttings away from the bit and return the cuttings up the annulus formed between an inner surface of the casing or wellbore and the outer surface of the drill string 10. The returns may flow through the annulus to the wellhead. The returns may continue from the wellhead and into the riser 25 via the PCA. The returns may flow up the riser 25 to the diverter 21. The returns may flow into the return line 329 via the diverter outlet. The returns may continue through to the shale shaker 33 and be processed thereby to remove the cuttings, thereby completing a cycle. As the drilling fluid and returns circulate, the drill string 10 may be rotated 16 by the top drive 5 and lowered by the traveling block 6, thereby extending the wellbore into the lower formation.

If no instability has been detected, the drill string 10 may be extended in the drilling mode once a top of the drill string 10 reaches the rig floor 4 as discussed above for the drilling system 1. If instability is detected, drilling may be halted by ceasing rotation of the drill string 10 and lowering of the top drive 5. One or more of the BOPs may be engaged with the drill string 10 and one of the choke valves opened to divert the flow of returns into the choke line 28. The rig choke 336 may or may not be tightened depending on the instability type. A density and/or other fluid property of the drilling fluid 60*d* may be changed according to the instability type and drilling may resume once the altered drilling fluid has circulated. Once the drill string 10 needs to be extended, the drilling system 301 may be shifted into the bypass mode. Further, should the top drive 5 fail, the drilling system may be shifted into the bypass mode.

Figure 6B:
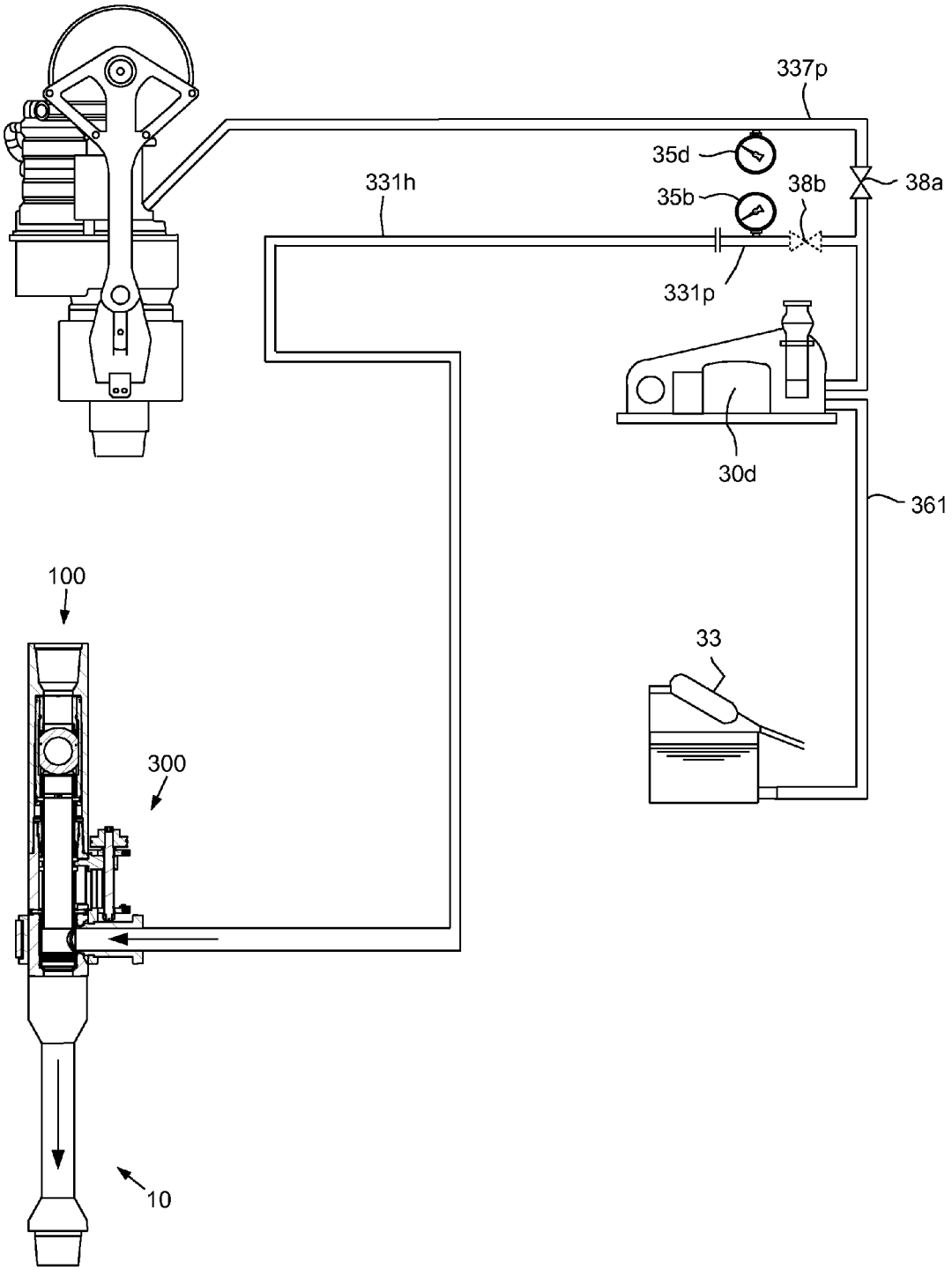
FIG. 6B illustrates the alternative drilling system in the bypass mode.

FIG. 6B illustrates the alternative drilling system 301 in the bypass mode. The clamp 300 may be similar to the clamp 200 except for omission of the actuator motors. The band and port valve actuator may be manually operated. Alternatively, the clamp 200 may be used in a manual override mode.

If shifting is due to the detection of instability, the drill string 10 may be extended in bypass mode once the top of the drill string 10 reaches the rig floor 4. In preparation of the shift, the stand may be replaced by the modified stand. Drilling may be stopped by stopping advancement and rotation 16 of the top drive 5 and removing weight from the drill bit 15. The spider may then be operated to engage the drill string 10. The manual clamp 300 may then be transported to the flow sub 100 and closed around the flow sub lower housing section 105*b*. The blind flange may be removed from the bypass spool 331*p* and a hose 331*h* connected to the bypass spool and the clamp 300. The rig crew may then manually rotate the tensioner bolt, thereby tightening the clamp 300 into engagement with the flow sub lower housing 105*b*. The backup tong 65*b* may be engaged with the top of the drill string 10. The rig crew may then open the bypass valve 38*b*. The rig crew may then manually rotate the lead screw, thereby raising the yoke and moving the flow sub sleeve. The upward movement of the sleeve may close the flow sub bore valve. Drilling fluid 60*d* may momentarily flow into the drill string 10 through both the side port 101 and the bore valve. Once the side port 101 is fully open, the rig crew may close the supply valve 38*a* and the modified stand may be added to the drill string 10 as discussed above.

If shifting is due to failure of the top drive 5, the rig crew may then hoist the clamp 300 to the flow sub 100 at the height where the top drive stalled. The blind flange may be removed from the bypass spool 331*p* and a hose 331*h* connected to the bypass spool and the clamp 300. The rig crew may then manually rotate the tensioner bolt, open the bypass valve 38*b*, and manually rotate the lead screw. Once the side port 101 is fully open, the rig crew may close the supply valve 38*a* and manually disconnect the quill 5*q* from the flow sub 100. The top drive 5 may then be raised clear of the flow sub 100 and serviced or replaced. Circulation may be maintained during the servicing of the top drive 5. Once the top drive 5 is again operational, the quill 5*q* may be reconnected to the flow sub 100 and flow restored through the top drive. Drilling may then continue in the drilling mode (no need to add the second flow sub). The bypass mode of the drilling system 1 may also be employed for top drive servicing in a similar fashion.

Figure 7:
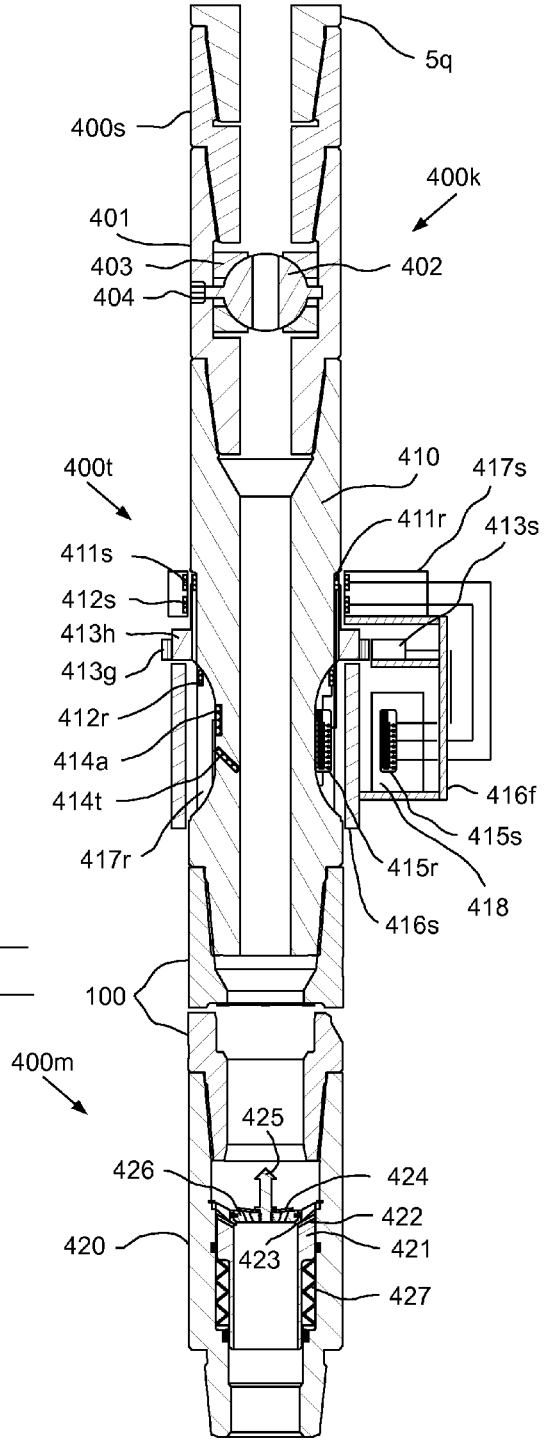
FIG. 7 illustrates optional accessories for a top drive system of any of the drilling systems.

FIG. 7 illustrates optional accessories for a top drive system of any of the drilling systems 1, 301, 501. The top drive system may include the top drive 5 and the flow sub 100. The top drive system may further include one or more of: a saver sub 400*s*, an internal blowout preventer (IBOP) 400*k*, a torque sub 400*t*, and an MSV 400*m*. The saver sub 400*s* may be directly connected to the quill 5*q*. The saver sub 400*s* may be tubular, have a bore formed therethrough, and have couplings, such as a threaded box or pin, formed at each end thereof. The saver sub 400*s* may endure wear caused by repeated connection and disconnection of other components to the top drive 5 instead of the quill 5*q* having to endure the wear. Alternatively, the saver sub 400*s* may be an adapter having a different size and/or type of lower coupling.

The IBOP 400*k* may include a housing 401, a closure member, such as a ball 402, a seat 403, and a linkage 404. The housing 401 may be tubular, have a bore formed therethrough, and have couplings, such as a threaded box or pin, formed at each end thereof. The housing 401 may include one or more sections (not shown), such as an upper section and a lower section, each section connected together, such as by a threaded connection. A chamber may be formed between the housing sections for receiving the ball 402 and seat 403. The ball 402 may be rotatable relative to the seat 403 between an open position (shown) and a closed position (not shown) by the linkage 404. The linkage 404 may interact with an actuator (not shown) of the top drive 5 for opening and closing the ball 402. In the closed position, engagement of the ball 402 with the seat 403 may seal the bore against upward flow of fluid from the drill pipe 10 to serve as a barrier in a well control event.

The torque sub 400*t* may include an outer non-rotating interface 418, an interface frame 416*f*, an inner torque shaft 410, one or more load cells 414*a,t*, one or more wireless couplings, a shaft electronics package 415*r*, an interface electronics package 415*s*, a turns counter, and a shield 416*s*. The shaft 410 may be tubular, have a bore formed therethrough, and have couplings, such as a threaded box or pin, formed at each end thereof. The shaft 410 may have a reduced diameter outer portion forming a recess in an outer surface thereof. The load cell 414*t* may include a circuit of one or more torsional strain gages and the load cell 414*a* may include a circuit of one or more longitudinal strain gages, each strain gage attached to an outer surface of the reduced diameter portion, such as by adhesive. The strain gages may each be made from metallic foil, semiconductor, or optical fiber.

The wireless couplings may include wireless power couplings and wireless data couplings. Each set of couplings may include a shaft member connected to the shaft and an interface member housed in an encapsulation 417*s* connected to the frame 416*f*. The wireless power couplings may each be inductive coils 411*r,s* and the wireless data couplings may each be antennas 412*r,s*. The shaft electronics may be connected by leads and the electronics package 415*r*, load cells 414*a,t*, and antenna 412*r* may be encapsulated 417*r* into the recess. The shield 416*s* may be located adjacent to the recess and may be connected to the frame 416*f*. Alternatively, the shield 416*s* may be connected to the shaft 410. The frame 416*f* may be may be connected to the top drive frame 5*f* by a bracket (not shown). Alternatively, the frame 416*f* may be connected to the torque shaft 410 by a swivel and have a bracket for torsional arrest by the rail 18.

The shaft electronics package 415*r* may include a microcontroller, a power converter, an ammeter and a transmitter. The power converter may receive an AC power signal from the power coupling and convert the signal to a DC power signal for operation of the shaft electronics. The DC power signal may be supplied to the load cells 414*a,t* and the ammeter may measure the current. The microcontroller may receive the measurements from the ammeter and digitally encode the measurements. The transmitter may receive the digitally encoded measurements, modulate them onto a carrier signal, and supply the modulated signal to the antenna 412*r*.

The interface antenna 412*s* may receive the modulated signal and the interface electronics package 415*s* may include a receiver for demodulating the signal. The interface package 415*s* may further include a microcontroller for digitally decoding the measurements and converting the measurements to torque and longitudinal load. The interface package 415*s* may send the converted measurements to the PLC 75 or rig controller via a data cable. The interface package 415*s* may further include a power converter for supplying the interface data coupling with the AC power signal. The interface package 415*s* may also be powered by the data cable or include a battery.

The turns counter may include a base 413*h* torsionally connected to the shaft, a turns gear 413*g* connected to the base, and a proximity sensor 413*s* connected to the frame 416*f* and located adjacent to the turns gear. The base 413*h* may be made from a nonmagnetic material, the 413*g* gear may be made from a magnetic material or permanently magnetic material, and the proximity sensor 413*s* may be a Hall Effect sensor. The proximity sensor 413*s* may include a semiconductor head and the interface package 415*s* may supply the head with a regulated current. The interface electronics package 415*s* may further include a voltmeter for detecting Hall voltage generated by rotation of the turns gear 413*g* relative to the proximity sensor 413*s*. The interface controller may then convert the measurement to angular speed and supply the converted measurement to the PLC 75 or rig controller.

During the drilling operation, the PLC 75 or rig controller may monitor torque, longitudinal load, and angular velocity for instability, such as sticking of the drill pipe 10 or collapse of the lower formation 104*b*.

The MSV 400*m* may include a housing 420, a piston 421, a seat 423, a plug 426, and a spring 427. The housing 420 may be tubular, have a bore formed therethrough, and have couplings, such as a threaded box or pin, formed at each end thereof. The housing 420 may also have an enlarged portion forming a recess in an inner surface thereof and a reduced portion connected by a shoulder. The piston 421 may have a head portion and a sleeve portion connected by a shoulder. The piston 421 may be disposed in the housing 420 and longitudinally movable relative thereto between a closed position (shown) and an open position (not shown). A chamber may be formed between the piston shoulder and the housing shoulder. The spring 427 may be disposed in the chamber against the shoulders and may bias the piston 421 toward the closed position. The spring 427 may be low profile, such as a Belleville spring.

The seat 423 may include an outer ring, an inner ring, and spokes connecting the rings. The spokes may be spaced apart to form flow passages therebetween. The seat 423 may be connected to the housing 420, such as by entrapment of the outer ring between a lip formed in the inner surface of the housing and a retainer, such as a snap ring received by a groove formed in the housing inner surface. The seat 423 may be made from the erosion resistant material. A cap 422 may be connected to the piston head, such as by an interference fit. The cap 422 may be made from the erosion resistant material. In the closed position engagement of the cap 422 with the seat 423 may seal the bore, thereby preventing spillage of drilling fluid 60*d* while adding the stand 11*a* in the drilling mode.

The plug 426 may be fastened to the seat 423, such as by one or more shearable fasteners. The plug 426 may have bypass flow passages formed therethrough. A shim 424 may be fastened to the plug by entrapment between a top of the plug 426 and a tab of a fishing neck 425. The shim 424 may flex between an open position (not shown) and a closed position (shown) and may close the passages in the closed position. The fishing neck 425 may be connected to the plug 426, such as by a threaded connection.

In operation, the piston 421 may move to the open position by fluid pressure exerted by the mud pump 30*d* during drilling. Once injection has stopped for adding the stand 11*a*, the spring 427 may move the piston 421 to the closed position. The spring 427 may exert sufficient force on the piston 421 to counter weight of the drilling fluid 60*d* in the top drive system and Kelly hose. Should pressure in the drill string 10 ever exceed pressure in the top drive system, the shim 424 may open to equalize pressure so as not to blind the supply pressure sensor 38*a*.

Should the MSV 400*m* be released with the flow sub 100 in bypass mode and it becomes necessary to deploy wireline through the drill string 10, the fishing neck 425 may be engaged by a fishing tool (not shown). Sufficient upward force exerted on the fishing neck 425 may break the shearable fasteners, thereby releasing the fishing neck and plug 426.

Figure 8A:
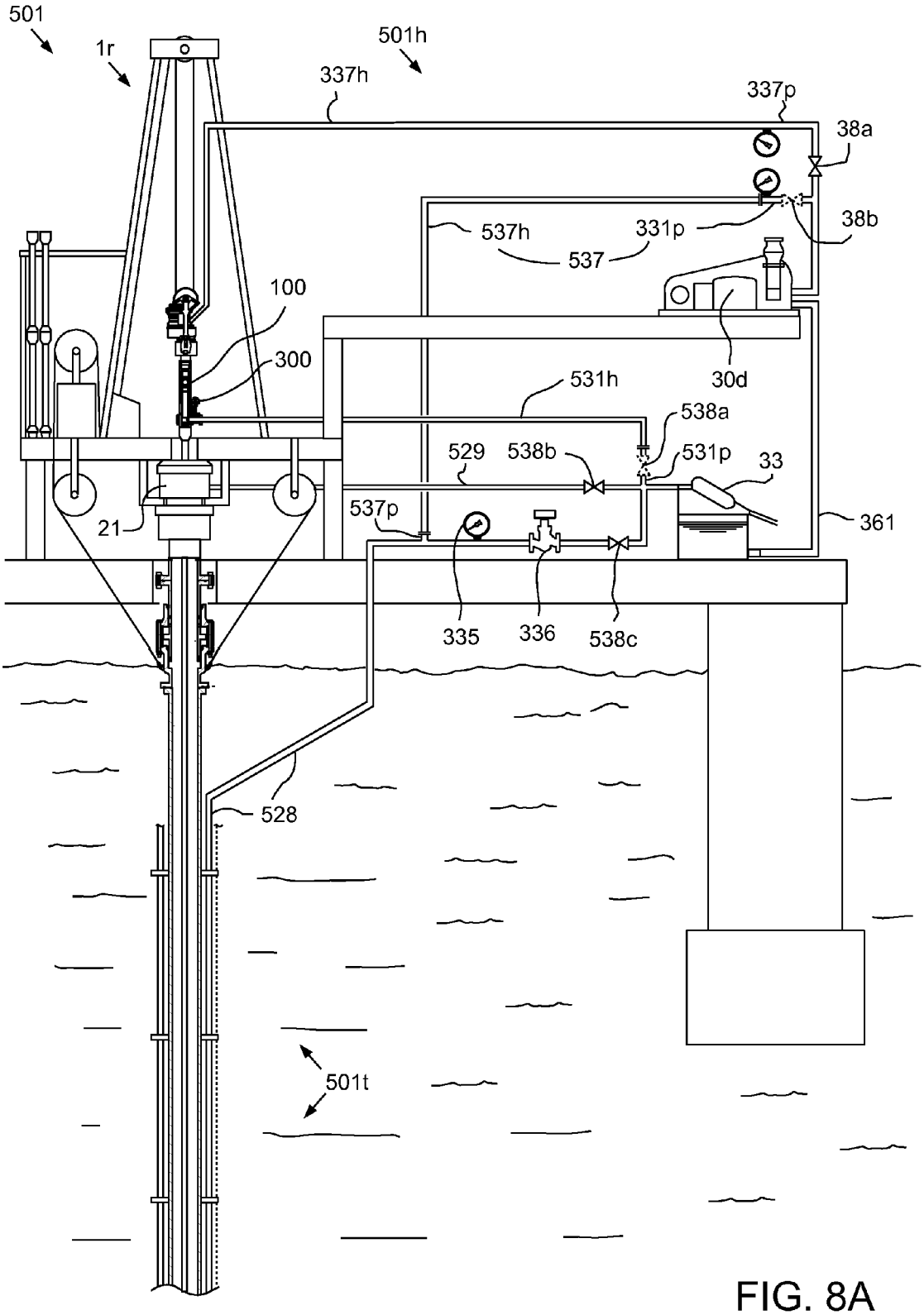
FIGS. 8A-8C illustrate an alternative drilling system in a reverse bypass mode, according to another embodiment of the present invention.
Figure 8B:
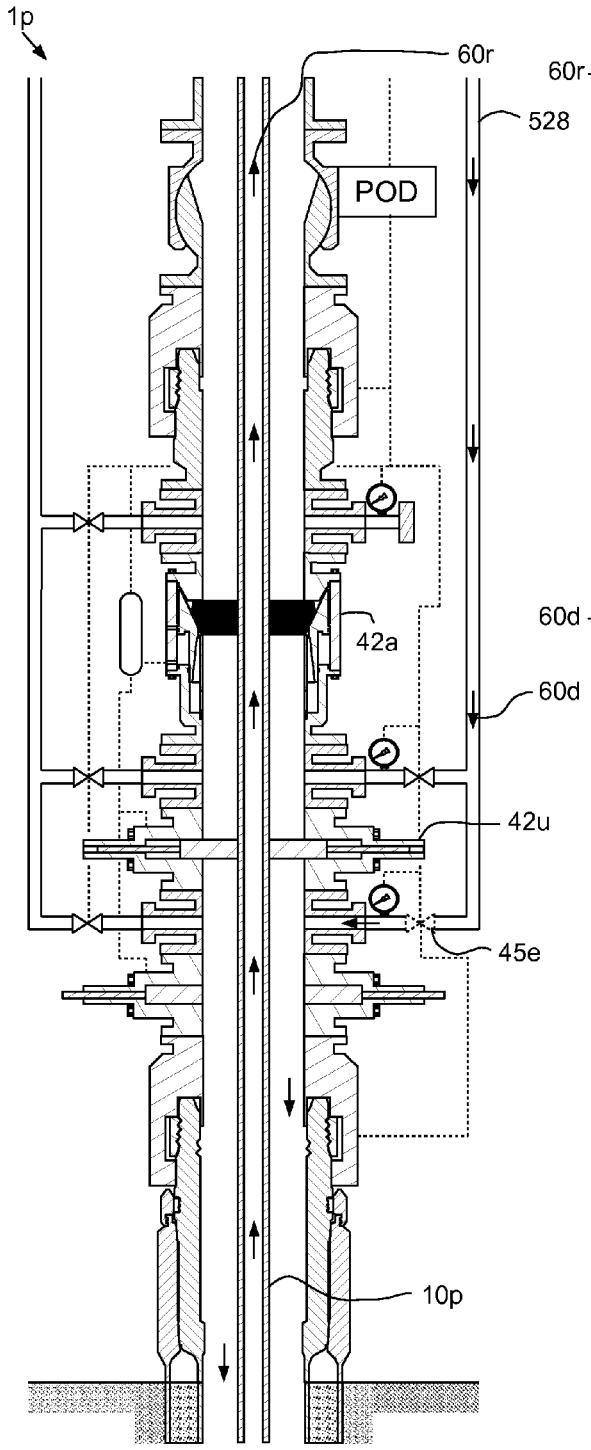
Figure 8C:
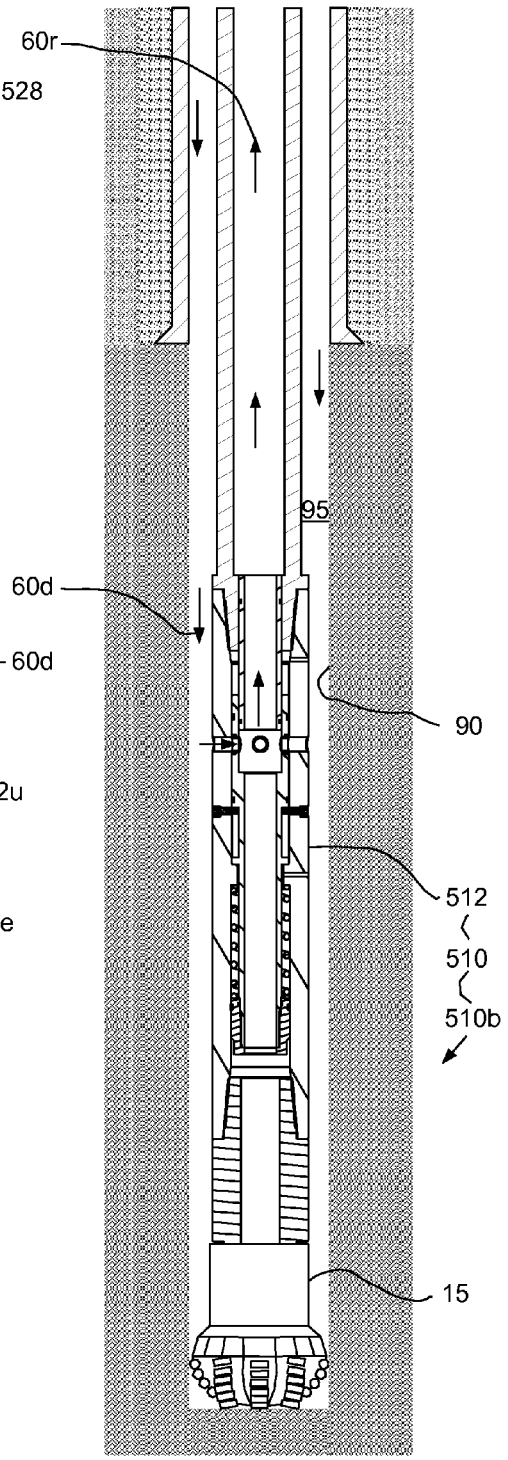

FIGS. 8A-8C illustrate an alternative drilling system 501 in a reverse bypass mode, according to another embodiment of the present invention. The drilling system 501 may include the MODU 1*m*, the drilling rig 1*r*, a fluid handling system

501*h*, a fluid transport system 501*t*, and the PCA 1*p*. The fluid transport system 501*t* may include a drill string 510, the upper marine riser package (UMRP) 320, the marine riser 25, the booster line 27, and a choke line 528. The drill string 510 may be similar to the drill string 10 except for the BHA 510*b* further including a circulation sub 512 and a control module (only stinger thereof shown).

The circulation sub 512 may include a body, an adapter, a piston, a mandrel, a biasing member, such as spring, and one or more fasteners, such as anti-rotation screws. The body may be tubular and have a longitudinal bore formed therethrough. Each longitudinal end of the body may be threaded for longitudinal and rotational connection to other members, such as a control module (not shown) at an upper end thereof and the adapter at a lower end thereof. The body may have one or more flow ports formed through a wall thereof. The body may also have a chamber formed therein at least partially defined by shoulder for receiving the piston. An end of the adapter distal from the body may also be threaded for longitudinal and rotational connection to another member of the BHA 510*b*. The mandrel may be a tubular, have a longitudinal bore formed therethrough, and may be disposed in the body bore. The mandrel may have a flow port formed through a wall thereof corresponding to each body port. The piston may be annular, have a longitudinal bore formed therethrough, and be longitudinally connected to a lower end of the mandrel, such as by a threaded connection.

In operation, the control module may receive a wireless instruction signal from the MODU 1*m*. The instruction signal may direct the control module to allow movement of the circulation sub 512 to an intermediate position. The module controller may open a solenoid valve of the control module. As drilling fluid is being circulated through the BHA 510*b*, the circulation sub piston may then move the mandrel and a follower of the control module to the intermediate position. During movement to the intermediate position, the mandrel ports may move out of alignment with the body ports and the stinger may move clear of the body ports. During movement, the module controller may monitor the circulation sub 512 using a position sensor. Once the mandrel has reached the intermediate position, the module controller may close the solenoid valve.

Flow of drilling fluid may then be halted. Pressure between the bore of the circulation sub 512 and the annulus 95 may equalize and the circulation sub spring may push the circulation sub piston and the mandrel to the open position. The module follower may be restrained from following the mandrel by the closed solenoid valve and the mandrel port may re-align with the body port, thereby opening the ports and providing fluid communication between a bore of the drill string and the annulus 95.

The fluid handling system 501*h* may include a return line 529, the mud pump 30*d*, a bypass line, the shale shaker 33, the pressure sensors 35*b,d*, the pressure gauge 335, the rig choke 336, the supply line, a reverse supply line 537, shutoff valves 38*a,b* 538*a-c*, and the clamp 300. A first end of the return line 529 may be connected to an outlet of the diverter 21 and a second end of the return line may be connected to the inlet of the shaker 33. The shutoff valve 538*b* may be assembled as part of the return line 529. An upper end of the choke line 528 may be connected to the shaker inlet. The rig choke 336, pressure gauge 335, shutoff valve 538*c*, and a lower reverse supply spool 537*p* may be assembled as part of the choke line 528. The lower reverse supply spool 537*p* may be blind flanged in the drilling mode. The upper reverse supply spool 331*p* may be connected to the outlet of the mud pump 30*d* and may be blind flanged in the drilling mode. A first end of the bypass spool 531*p* may be connected to the shaker inlet and a second end of the bypass spool may be blind flanged in the drilling mode.

In the drilling mode, the mud pump 30*d* may pump the drilling fluid 60*d* from the transfer line 361 (or fluid tank connected thereto), through the pump outlet, standpipe 337*p* and Kelly hose 337*h* to the top drive 5. The drilling fluid 60*d* may flow from the Kelly hose 337*h* and into the drill string 510 via the top drive 5 and flow sub 100. The drilling fluid 60*d* may flow down through the drill string 510 and exit the drill bit 15 (circulation 512 sub closed), where the fluid may circulate the cuttings away from the bit 15 and return the cuttings up the annulus 95. The returns 60*r* may flow through the annulus 95 to the wellhead 50. The returns 60*r* may continue from the wellhead 50 and into the riser 25 via the PCA 1*p*. The returns 60*r* may flow up the riser 25 to the diverter 21. The returns 60*r* may flow into the return line 529 via the diverter outlet. The returns 60*r* may continue through the open shutoff valve 538*b* to the shale shaker 33 and be processed thereby to remove the cuttings, thereby completing a cycle. As the drilling fluid 60*d* and returns 60*r* circulate, the drill string 10 may be rotated 16 by the top drive 5 and lowered by the traveling block 6, thereby extending the wellbore 90 into the lower formation 94*b*.

If no instability has been detected, the drill string 10 may be extended in the drilling mode once a top of the drill string 10 reaches the rig floor 4 as discussed above for the drilling system 1. If instability is detected and/or should the top drive 5 fail, the drilling system 501 may be shifted into the (forward) bypass mode as discussed above for the drilling system 301.

Periodically, a cleaning operation may be performed to remove residual cuttings from the wellbore 90 that forward circulation of the drilling fluid 60*d* is unable to transport to the MODU 1*m*. The drilling system 501 may be shifted into the reverse bypass mode for the cleaning operation. Drilling may be stopped by stopping advancement and rotation 16 of the top drive 5. The instruction signal may be sent to the control module to open the circulation sub 512. The manual clamp 300 may then be transported to the flow sub 100 and closed around the flow sub lower housing section 105*b*. The blind flange may be removed from the bypass spool 531*p* and a hose 531*h* connected to the bypass spool and the clamp 300. The blind flanges may be removed from the upper and lower reverse supply spools 331*p*, 537*p* and a hose 537*h* may be connected to the reverse supply spools.

The rig crew may then manually rotate the tensioner bolt, thereby tightening the clamp 300 into engagement with the flow sub lower housing 105*b*. The PCA valve 45*e* and the reverse supply valve 38*b* may then be opened and the supply valve 38*a* closed, thereby diverting the drilling fluid supply down the choke line 528 and into the PCA bore. The rig crew may then manually rotate the lead screw, thereby raising the yoke and moving the flow sub sleeve. The upward movement of the sleeve may close the flow sub bore valve. Once the side port 101 is fully open, the rig crew may open the bypass valve 538*a* and close the return valve 538*b*. The annular BOP 42*a* and the upper one 42*u* of the ram preventers 42*u,b* may then be closed against the drill string 10, thereby forcing the drilling fluid 60*d* down the annulus 95. The drilling fluid 60*d* may wash the residual cuttings from the annulus 95. The returns 60*r* may be discharged from the annulus 95 into the open circulation sub 512. The returns 60*r* may continue up the drill string 510 at an increased velocity relative to forward circulation, thereby improving cuttings carrying capability. Once the annulus 95 has been cleaned, the system 501 maybe shifted back to the drilling mode for continuation of the drilling operation (unless total depth has been reached, then to a tripping mode).

Alternatively, the reverse bypass mode may be utilized if instability is detected. In such a situation, the reverse bypass mode may be used to circulate out a kick of formation fluid and/or to bullhead the lower formation 94*b*. The circulation sub 512 may be opened for circulating a kick and remain closed for bullheading. Additionally, the control module may repeatedly open and close the circulation sub 512 so that the cleaning and/or kick circulation operations may be performed periodically after drilling a segment of the lower formation and/or while tripping the drill string into and/or from the wellbore.

Alternatively, the drilling system 1 may be modified to have reverse bypass mode capability by connecting a reverse supply line from the bypass spool 37*p* to the RCD outlet (would now be an inlet) and connecting the bypass hose 37*h* to the shaker inlet. The drilling fluid 60*d* would then be injected into the RCD inlet and be forced by the RCD 26 to flow down the riser 25 into the annulus 95 instead of being injected down the choke line with the BOPs closed.

Figure 9A:
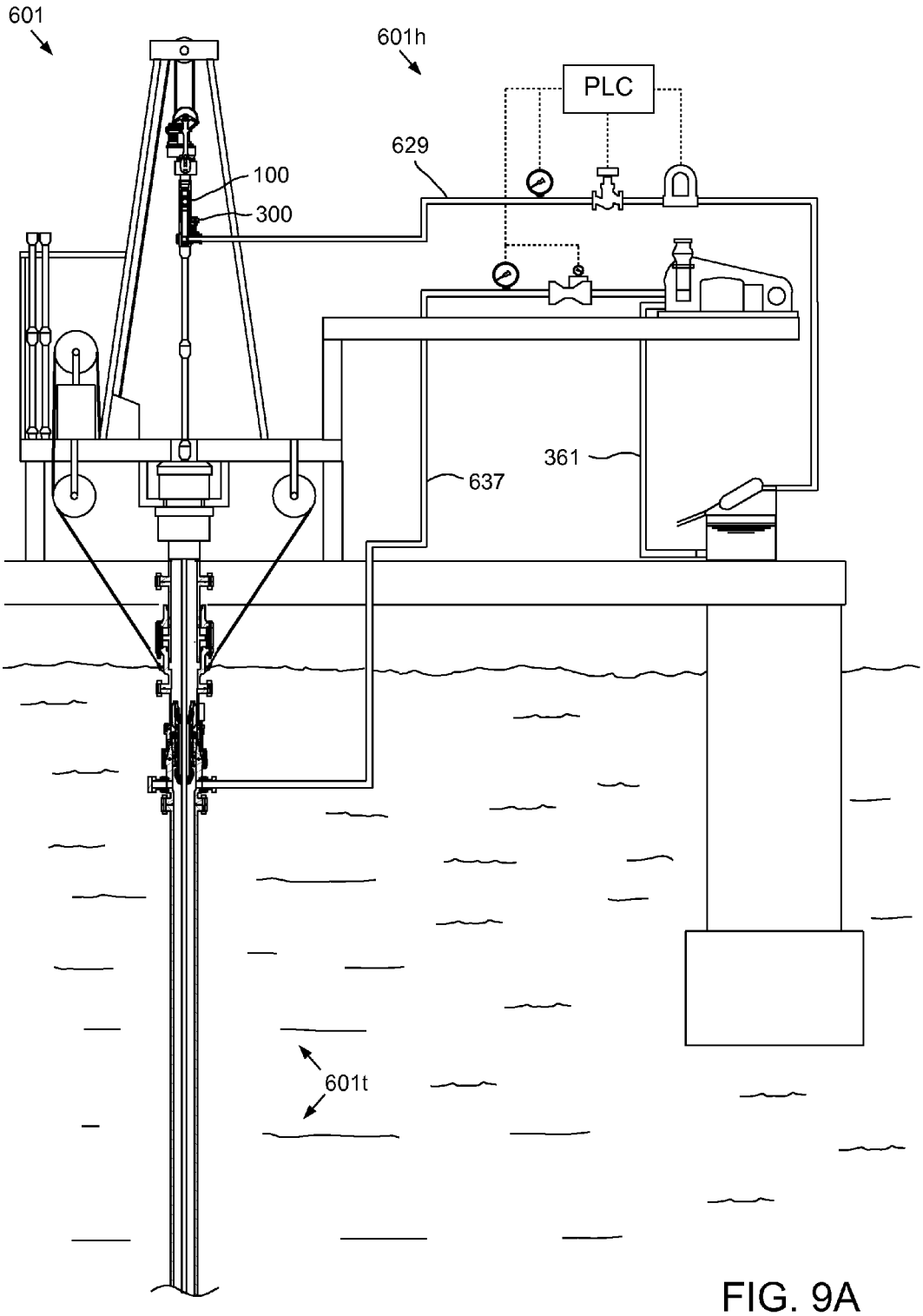
FIGS. 9A-9C illustrate an alternative drilling system in a reverse drilling mode, according to another embodiment of the present invention.
Figure 9B:
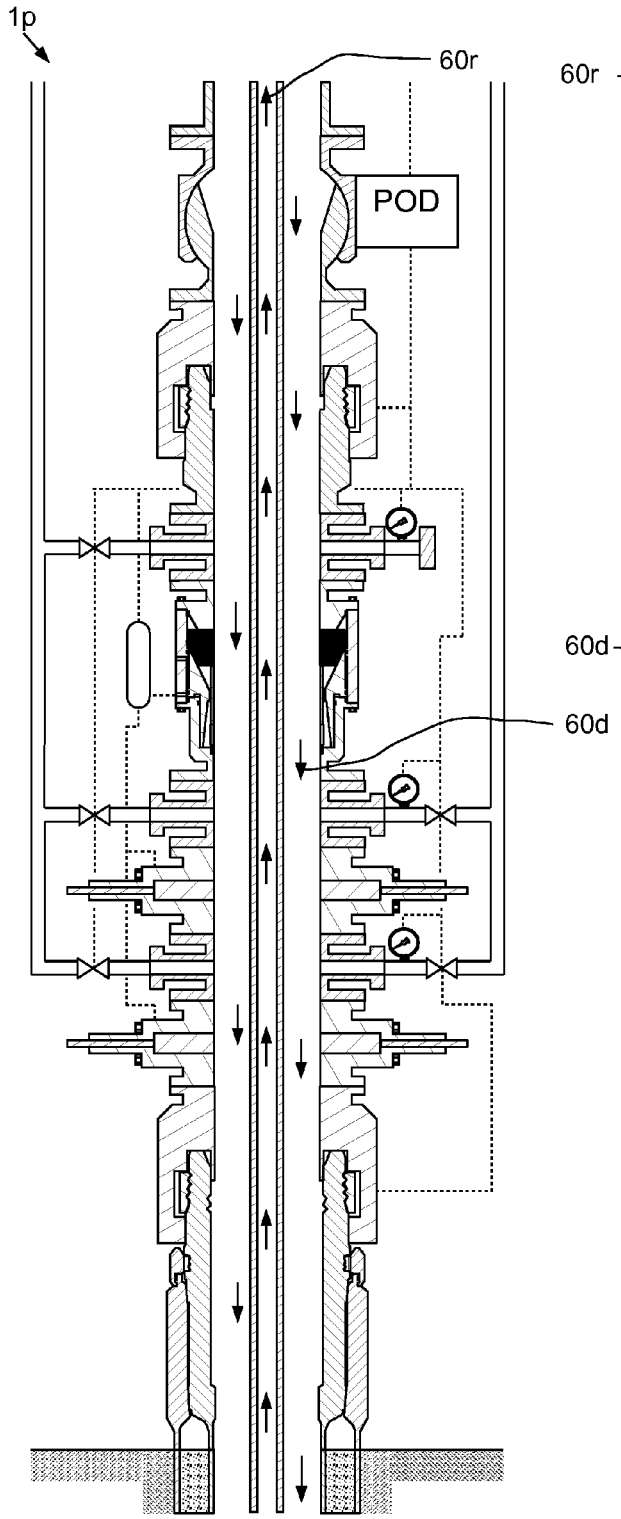
Figure 9C:
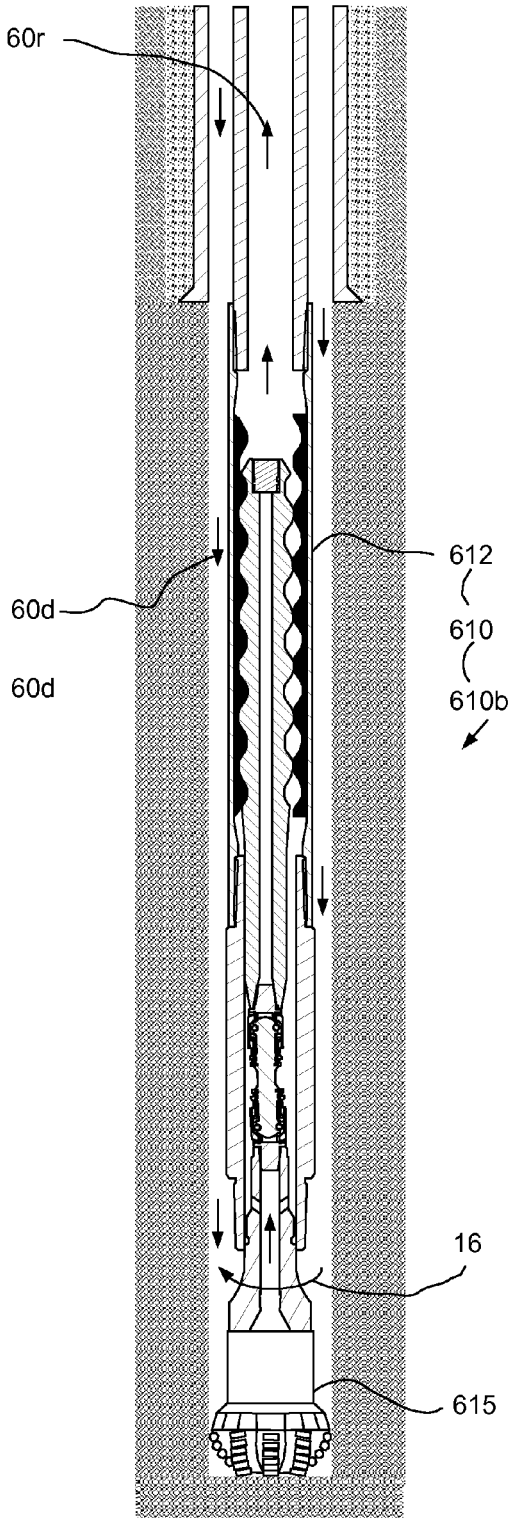

FIGS. 9A-9C illustrate an alternative drilling system 601 in a reverse drilling mode, according to another embodiment of the present invention. The drilling system 601 may include the MODU 1*m*, the drilling rig 1*r*, a fluid handling system 601*h*, a fluid transport system 601*t*, the PCA 1*p*, and the PLC. The fluid transport system 601*t* may include a drill string 610, the upper marine riser package (UMRP) 20, the marine riser 25, the booster line, and the choke line. The drill string 610 may be similar to the drill string 10 except for the BHA 610*b* further including a drilling motor, such as progressive cavity motor 612 and a reverse circulation drill bit 615 instead of the (forward circulation) drill bit 15.

The motor 612 may include a dump valve (not shown), a power section, a mechanical joint, and a bearing section (not shown). The power section may harness fluid energy from the returns 60*r* and utilize the harnessed energy to rotationally drive the drill bit 615. The power section may include a rotor, a stator, and a stator housing. The rotor and stator housing may be made from a metal or alloy or a corrosion resistant alloy. The stator may be made from an elastomer or an elastomeric copolymer.

The rotor may have one or more lobes formed in an outer surface thereof and helically extending therealong. For interaction with the rotor lobes, the stator may have two or more lobes (equal to the number of rotor lobes plus one) formed in an outer surface thereof and helically extending therealong. The rotor and stator may interact at the helical lobes to form a plurality of cavities (aka chambers) and sealing surfaces isolating the cavities from the each other. To effectuate the seal, the rotor and stator may be sized to form an interference fit. Alternatively, the stator housing may have the lobed profile formed in an inner surface thereof, thereby allowing a thickness of the stator to be reduced and to be uniform.

The fluid handling system 601*h* may include a return line 629, the mud pump, the shale shaker, the supply and returns flow meters, the supply and returns pressure sensors, the returns choke, a supply line 637, and the clamp 300. An upper end of the return line 629 may be connected to the clamp inlet (now an outlet) and a lower end of the return line may be connected to the shaker inlet. The returns choke, returns pressure sensor, and returns flow meter may be assembled as part of the return line 629. An upper end of the supply line 637 may be connected to the mud pump outlet and a lower end of the supply line may be connected to the RCD outlet (now an inlet). The supply pressure sensor, and supply flow meter may be assembled as part of the supply line 637.

In the reverse drilling mode, the mud pump 30*d* may pump the drilling fluid 60*d* from the transfer line 361 (or fluid tank connected thereto), through the pump outlet and supply line 637 to the RCD. The drilling fluid 60*d* may flow down the riser 25 and the drill string 610, through the PCA 1*p*, and into the annulus, where the fluid may circulate the cuttings into the bit 615. The returns 60*r* may flow through the BHA 610*b*, thereby powering the motor 612 to rotate 16 the bit 615. The returns 60*r* may continue from the BHA 610*b*, through the drill pipe 10*p*, and to the CFS 100 (in the side injection mode). The returns 60*r* be diverted by the CFS 100 into the return line 629 via the clamp outlet. The returns 60*r* may continue through the returns pressure sensor, returns choke, and returns flow meter to the shale shaker 33 and be processed thereby to remove the cuttings, thereby completing a cycle. As the drilling fluid 60*d* and returns 60*r* circulate, the drill bit 10 may be rotated 16 by the motor 612 and lowered by the traveling block 6, thereby extending the wellbore 90 into the lower formation 94*b*.

If no instability has been detected, the drill string 610 may be extended in the reverse drilling mode once a top of the drill string reaches the rig floor by adding the stand 11*a*. Extension of the drill string in reverse drilling mode may be similar to extension of the drill string 10 of drilling system 1 in drilling mode except that the CFS 100 may remain in the side injection mode with the clamp 300 engaged with the CFS and a rotary table (not shown) of the drilling rig may be used instead of the drive tong to make up the connection between the CFS 100 and the added stand by rotating the drill string 610 instead of the CFS. If instability is detected, the drilling system 601 may be extended while maintaining continuous circulation by: disconnecting the top drive from the CFS 100, connecting the modified stand to the drill string 610, connecting the top drive to the modified stand, engaging a second clamp (not shown) to the second CFS of the modified stand (at a height from the rig floor), connecting a return bypass line to the second CFS (at the height), switching the second CFS to side injection mode, and switching the CFS 100 to the top injection mode.

Alternatively, the drilling system 601 may be convertible between the reverse circulation drilling mode and a forward circulation drilling mode.

Alternatively, the drilling system 601 may include a rotating CFS (not shown) or rotating clamp (not shown) instead of the CFS 100 or clamp 300, as discussed in US Pat. Pub. No. 2011/0155379, which is herein incorporated by reference in its entirety. The rotating CFS or clamp may allow use of the top drive to make up the connections and/or to drill the wellbore while the clamp is engaged with the CFS.

Alternatively, any of the drilling systems 1, 301, 501, 601 may be utilized for running casing or liner to reinforce and/or drill the wellbore 90, or for assembling work strings to place downhole components in the wellbore.

While the foregoing is directed to embodiments of the present invention, other and further embodiments of the invention may be devised without departing from the basic scope thereof, and the scope thereof is determined by the claims that follow.

The invention claimed is:

1. A method for deploying a tubular string into a wellbore, comprising:

injecting fluid through a top drive and a flow sub into a top of the tubular string and lowering the tubular string into the wellbore, wherein:

the flow sub connects the tubular string top to a quill of the top drive, the flow sub is in a top injection mode, and the flow sub has:

a closed port formed through a wall thereof, and an open bore conducting the fluid from the quill into the tubular string top;

halting injection of the fluid through the top drive and the tubular string and halting lowering of the tubular string;

while injection and lowering are halted:

disconnecting the flow sub from the tubular string top;

adding one or more tubular joints to the tubular string; and connecting the flow sub to a top of the added joints; and resuming injection of the fluid through the top drive and lowering of the tubular string.

2. The method of claim 1, further comprising:

halting lowering of the tubular string;

while lowering is halted, shifting the flow sub to a side injection mode, thereby opening the port and closing the bore, and injecting the fluid into the port; and while injecting the fluid into the port:

halting injection of the fluid through the top drive;

disconnecting the quill from the flow sub; and adding a stand to the tubular string, the stand having a second flow sub and one or more of the tubular joints.

3. The method of claim 2, further comprising monitoring an exposed formation adjacent to the wellbore for instability, wherein the flow sub is shifted to the side injection mode in response to detection of the instability.

4. The method of claim 3, wherein the formation is monitored by:

measuring a flow rate of the injected fluid;

measuring a flow rate of fluid returning from the wellbore; and comparing the flow rates.

5. The method of claim 2, wherein each flow sub comprises:

a port valve for closing the port in the top injection mode and for opening the port in the side injection mode, and a bore valve operably coupled to the port valve for opening the bore in the top injection mode and for closing the bore in the side injection mode.

6. The method of claim 5, wherein:

the flow sub is shifted to the side injection mode by:

engaging the flow sub with a clamp; and operating an automated actuator of the clamp to open the port valve, thereby also closing the bore valve, and the fluid is injected into the port via an inlet of the clamp.

7. The method of claim 1, wherein:

the tubular string is a drill string having a drill bit disposed at a bottom thereof, the fluid is mud, and the method further comprises rotating the drill bit while injecting the mud and lowering the drill string, thereby drilling the wellbore.

8. The method of claim 1, further comprising:

halting lowering of the tubular string due to failure of the top drive; and while lowering is halted:

shifting the flow sub to a side injection mode, thereby opening the port and closing the bore, and injecting the fluid into the port; and while injecting the fluid into the port:

disconnecting the quill from the flow sub; and servicing or replacing the top drive.

9. A top drive system, comprising:

a flow sub, comprising:

a tubular housing having: a longitudinal bore formed therethrough, a flow port formed through a wall thereof, an upper coupling, and a lower coupling for connection to a tubular;

a bore valve operable between an open position and a closed position, wherein the bore valve allows free passage through the bore in the open position and isolates an upper portion of the bore from a lower portion of the bore in the closed position; and a valve member for selectively opening and closing the flow port; and a top drive comprising:

a motor operable to rotate a quill;

a swivel having an inlet for receiving a kelly hose and an outlet in fluid communication with the quill; and a backup wrench movable between an upper position and a lower position, wherein:

the motor, swivel, and backup wrench are connected together to form a frame of the top drive, the upper coupling is connected to the quill, the backup wrench is engageable with an upper portion of the tubular housing in the upper position, the backup wrench is engageable with a threaded coupling of the tubular housing in the lower position, the valve member is a sleeve, the sleeve is disposed in the tubular housing, the sleeve is movable between an open position where the flow port is exposed to the bore and a closed position where a wall of the sleeve is disposed between the flow port and the bore, and the flow sub further comprises a bore valve actuator operably coupling the sleeve and the bore valve such that opening the sleeve closes the bore valve and closing the sleeve opens the bore valve.

10. The system of claim 9, further comprising a clamp comprising:

an inlet for injecting fluid into the flow port and operable to engage the valve member and seal against a surface of the tubular housing adjacent to the flow port; and an automated valve actuator for operating the valve member to open and close the port.

11. The system of claim 9, further comprising an internal blowout preventer comprising a valve member, a seat, and a linkage operable by the top drive to open and close the valve member, wherein the internal blowout preventer connects the flow sub to the quill.

12. The system of claim 9, further comprising a torque sub comprising a turns counter and a torque shaft having a load cell and connecting the flow sub to the quill.

13. The system of claim 9, further comprising a mud saver valve operable to open in response to fluid pumped through the top drive and to close in response to cessation of pumping.

14. A method for deploying a tubular string into a wellbore, comprising:

injecting fluid through a top drive and a flow sub into a top of the tubular string and lowering the tubular string into the wellbore, wherein:

the flow sub connects the tubular string top to a quill of the top drive, the flow sub is in a top injection mode, and the flow sub has:

a port formed through a wall thereof, a valve member closing the port, and an open bore conducting the fluid from the quill into the tubular string top;

halting lowering of the tubular string; and while lowering is halted, shifting the flow sub to a side injection mode, thereby moving the valve member to open the port and closing the bore, and injecting the fluid into an annulus of the wellbore, thereby circulating from the annulus, up a bore of the tubular string, and to the port.

15. A method for deploying a tubular string into a wellbore, comprising:

injecting fluid into an annulus of the wellbore, thereby circulating from the annulus, up a bore of the tubular string, and to an open port of a flow sub connected to a top of the tubular string and lowering the tubular string into the wellbore, wherein:

the tubular string has a bottomhole assembly, the bottomhole assembly includes a reverse circulation drill bit and a drilling motor, and the drilling motor utilizes the injected fluid to rotate the drill bit, thereby drilling the wellbore;

halting injection of the fluid through the annulus and the tubular string and halting lowering of the tubular string;

while lowering is halted:

disconnecting the flow sub from the tubular string top;

adding one or more tubular joints to the tubular string and connecting the flow sub to a top of the added joints; and resuming lowering of the tubular string.

* * * * *